US008830145B2

(12) United States Patent
Okuno et al.

(10) Patent No.: US 8,830,145 B2
(45) Date of Patent: Sep. 9, 2014

(54) PIXEL CIRCUIT AND DISPLAY DEVICE

(75) Inventors: Takeshi Okuno, Yongin-si (KR); Hirofumi Katsuse, Yongin-si (KR); Ryo Ishii, Yongin-si (KR); Naoaki Komiya, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 160 days.

(21) Appl. No.: 13/614,174

(22) Filed: Sep. 13, 2012

(65) Prior Publication Data

US 2013/0135275 A1 May 30, 2013

(30) Foreign Application Priority Data

Sep. 13, 2011 (JP) ..... 2011-199214

(51) Int. Cl.
*G09G 3/30* (2006.01)
*G09G 3/36* (2006.01)

(52) U.S. Cl.
USPC ..... 345/76; 345/92

(58) Field of Classification Search
CPC ..... G09G 2300/0842; G09G 3/3233; G09G 2320/043
USPC ..... 345/76, 92
See application file for complete search history.

(56) References Cited

U.S. PATENT DOCUMENTS

| | | | | |
|---|---|---|---|---|
| 8,237,634 | B2 | 8/2012 | Kwak | |
| 2007/0164959 | A1 * | 7/2007 | Childs | 345/92 |
| 2009/0201231 | A1 | 8/2009 | Takahara et al. | |
| 2010/0277401 | A1 * | 11/2010 | Takahara et al. | 345/76 |
| 2011/0025671 | A1 | 2/2011 | Lee | |

FOREIGN PATENT DOCUMENTS

| | | |
|---|---|---|
| JP | 2009-276744 | 11/2009 |
| KR | 10-2010-0009219 | 1/2010 |
| KR | 10-2011-0136775 | 12/2011 |

* cited by examiner

*Primary Examiner* — Kevin M Nguyen
(74) *Attorney, Agent, or Firm* — Christie, Parker & Hale, LLP

(57) ABSTRACT

A pixel circuit includes: a light emitting element whose cathode is connected to a first power source for supplying a first power supply voltage; a first transistor having a first terminal connected to a data line and having a gate terminal; a second transistor connected between the gate terminal of the first transistor and a second terminal of the first transistor and having a gate terminal; a third transistor connected between the second terminal of the first transistor and an anode of the light emitting element and having a gate terminal; a fourth transistor connected between the gate terminal of the first transistor and an initialization power source and having a gate terminal; and a capacitor having one end connected to a power source for supplying a voltage having a fixed potential and the other end connected to the gate terminal of the first transistor.

31 Claims, 12 Drawing Sheets

PIXEL CIRCUIT AND DISPLAY DEVICE

CROSS-REFERENCE TO RELATED APPLICATION

This application claims priority to and the benefit of Japan Patent Application No. 2011-199214 filed in the Japan Intellectual Property Office on Sep. 13, 2011, the entire contents of which are incorporated herein by reference.

BACKGROUND OF THE INVENTION (a) Field of the Invention

The present invention relates to a pixel circuit and a display device.

(b) Description of the Related Art

In recent years, various display devices, such as organic EL displays (organic Electroluminescence displays, also called as OLED displays (Organic Light Emitting Diode displays)), FEDs (Field Emission Displays), PDPs (Plasma Display Panels), and the like, have been developed as devices to replace CTR displays (Cathode Ray Tube displays).

Amongst the various display devices mentioned above, the organic EL displays are self-luminescence type display devices that use an electroluminescence phenomenon.

They have drawn particular attention of people as devices for the next generation, because they are superior to display devices in their moving image characteristics, viewing angle characteristics, color reproducibility, etc.

The electroluminescence phenomenon is a phenomenon in which the state of an electron of a material (an organic EL element) changes from the ground state to the excited state so as to return from the excited state, which is unstable, to the ground state, which is stable, whereby the difference of energy is emitted in the form of light.

Moreover, high picture quality technologies for a display device having an organic EL element as a light emitting element have been developed.

An example of the technology for achieving high picture quality by compensating for variations in the characteristics of a driving transistor of each pixel may include the technology of Patent Document 1.

In the case of a display panel (e.g., active matrix display panel) of a display device having an organic EL element (hereinafter, simply referred to as a display device) which is formed of, for example, low-temperature polysilicon (LTPS), variations may occur in the characteristics of a thin film transistor (hereinafter, may be simply referred to as a transistor) of each pixel.

The light emission luminance of the organic EL element changes with the amount of current flowing through the organic EL element.

Accordingly, when there occur variations in the characteristics of a transistor of each pixel, the amount of current flowing through the organic EL element of each pixel changes, and as a result non-uniformity appears in a displayed image.

In this regard, it is preferable to compensate for variations in the characteristics of a transistor of each pixel in order to achieve high picture quality by preventing deterioration of display quality.

Examples of methods for compensating for variations in the characteristics of a transistor may include a method (internal correction) in which variations in the characteristics of a transistor are compensated for inside a pixel and a method (external correction) in which variations in the characteristics of a transistor are compensated for by generating correction data in a circuit outside a pixel.

For example, internal correction is mainly used for a display device (so-called small or medium sized display panel) employed in portable devices such as cell phones, smartphones, etc, due to the demand for cost reduction or circuit area reduction.

In the case of internal correction, as exemplified in a conventional pixel of Patent Document 1, a plurality of transistors and a capacitor element (capacitor) need to be formed within a pixel (hereinafter, a circuit constituting a pixel will be referred to as a pixel circuit).

However, there is the possibility that an increase in the number of transistors constituting a pixel circuit may cause, for example, a reduction in the aperture ratio of the display panel.

Moreover, assuming that display panels are upscaling from HD (High Definition) resolution, 4K resolution, 8K resolution, and beyond, an increase in the number of transistors constituting a pixel circuit may realize a high-precision display panel, but at the same time cause a failure.

The above information disclosed in this Background section is only for enhancement of understanding of the background of the invention and therefore it may contain information that does not form the prior art that is already known in this country to a person of ordinary skill in the art.

SUMMARY OF THE INVENTION

Accordingly, there is demand for a pixel circuit with a reduced number of elements (i.e., a simplified pixel circuit).

The present invention has been made in an effort to provide a novel and improved pixel circuit and a display device which have a reduced number of elements constituting the pixel circuit and can achieve high picture quality.

An exemplary embodiment of the present invention provides a pixel circuit including: a light emitting element whose cathode is connected to a first power source for supplying a first power supply voltage; a first transistor that has a first terminal connected to a data line and is selectively conducted with a voltage applied to a gate terminal; a second transistor that is connected between the gate terminal of the first transistor and a second terminal of the first transistor and is selectively conducted in response to a first scan signal applied to a gate terminal; a third transistor that is connected between the second terminal of the first transistor and an anode of the light emitting element and is selectively conducted in response to a light emission control signal applied to a gate terminal; a fourth transistor that is connected between the gate terminal of the first transistor and an initialization power source and is selectively conducted in response to a second scan signal applied to a gate terminal; and a capacitor element, one end of which is connected to a power source for supplying a voltage having a fixed potential and the other end of which is connected to the gate terminal of the first transistor, wherein, during a non-light emission period of one frame in which the light emitting element emits no light, a data signal is applied to the data line, and during a light emission period of one frame in which the light emitting element emits light in response to the data signal, a second power supply voltage having a higher potential than the first power supply voltage is applied to the data line.

By this configuration, a pixel may include four transistors and one capacitor element, and variations in the threshold voltage of the first transistor serving as a driving transistor may be compensated for.

Accordingly, the number of elements constituting the pixel circuit can be reduced, and high picture quality can be achieved.

During a first period of the non-light emission period, the fourth transistor may be conducted to thus initialize the potential of the gate terminal of the first transistor to the potential of a voltage supplied from the initialization power source, and during a second period subsequent to the first period of the non-light emission period, the second transistor may be conducted to thus perform a threshold compensation operation for compensating for a threshold voltage conducted by the first transistor and a data writing operation for storing charge corresponding to the data signal in the capacitor element.

The third transistor may be conducted not during the non-light emission period but during the light emission period.

The power source to which one end of the capacitor element is connected may be a second power source for supplying the second power supply voltage.

The power source to which one end of the capacitor element is connected may be the initialization power source.

Another exemplary embodiment of the present invention provides a pixel circuit including: a first transistor that has a first terminal connected to a data line and is selectively conducted with a voltage applied to a gate terminal; a second transistor that is connected between the gate terminal of the first transistor and a second terminal of the first transistor and is selectively conducted in response to a first scan signal applied to a gate terminal; a fourth transistor that is connected between the gate terminal of the first transistor and an initialization power source and is selectively conducted in response to a second scan signal applied to a gate terminal; a capacitor element, one end of which is connected to a power source for supplying a voltage having a fixed potential and the other end of which is connected to the gate terminal of the first transistor; and a light emitting element whose cathode is connected to a first power source for supplying a power supply voltage having a potential of a first level or a potential of a second level which is lower than the first level and whose anode is connected to the second terminal of the first transistor, wherein, during a non-light emission period of one frame in which the light emitting element emits no light, a data signal is applied to the data line, and the potential of the power supply voltage supplied from the first power source is fixed to the potential of the first level, and during a light emission period of one frame in which the light emitting element emits light in response to the data signal, the power supply voltage having the potential of the first level is applied to the data line, and the potential of the power supply voltage supplied from the first power source is changed from the potential of the first level to the potential of the second level.

By this configuration, a pixel may include three transistors and one capacitor element, and variations in the threshold voltage of the first transistor serving as a driving transistor may be compensated for.

Accordingly, the number of elements constituting the pixel circuit can be reduced, and high picture quality can be achieved.

A still another exemplary embodiment of the present invention provides a display device including: a display unit that has data lines and scan lines arranged in a matrix and pixel circuits arranged in a matrix so as to correspond to crossing points of the data lines and the scan lines; a scan driver that applies a scan signal to the scan lines; and a data driver that applies a data signal to the data lines, each of the pixel circuits including: a light emitting element whose cathode is connected to a first power source for supplying a first power supply voltage; a first transistor that has a first terminal connected to a data line and is selectively conducted with a voltage applied to a gate terminal; a second transistor that is connected between the gate terminal of the first transistor and a second terminal of the first transistor and is selectively conducted in response to a first scan signal applied to a gate terminal; a third transistor that is connected between the second terminal of the first transistor and an anode of the light emitting element and is selectively conducted in response to a light emission control signal applied to a gate terminal; a fourth transistor that is connected between the gate terminal of the first transistor and an initialization power source and is selectively conducted in response to a second scan signal applied to a gate terminal; and a capacitor element, one end of which is connected to a power source for supplying a voltage having a fixed potential and the other end of which is connected to the gate terminal of the first transistor, wherein, during a non-light emission period of one frame in which the light emitting element emits no light, the data driver applies a data signal to the data line, and during a light emission period of one frame in which the light emitting element emits light in response to the data signal, the data driver applies a second power supply voltage having a higher potential than the first power supply voltage to the data line.

By this configuration, a pixel may include four transistors and one capacitor element, and variations in the threshold voltage of the first transistor serving as a driving transistor may be compensated for.

Accordingly, the number of elements constituting the pixel circuit can be reduced, and high picture quality can be achieved.

A yet another exemplary embodiment of the present invention provides a display device including: a display unit that has data lines and scan lines arranged in a matrix and pixel circuits arranged in a matrix so as to correspond to crossing points of the data lines and the scan lines; a scan driver that applies a scan signal to the scan lines; and a data driver that applies a data signal to the data lines, each of the pixel circuits including: a first transistor that has a first terminal connected to a data line and is selectively conducted with a voltage applied to a gate terminal; a second transistor that is connected between the gate terminal of the first transistor and a second terminal of the first transistor and is selectively conducted in response to a first scan signal applied to a gate terminal; a fourth transistor that is connected between the gate terminal of the first transistor and an initialization power source and is selectively conducted in response to a second scan signal applied to a gate terminal; a capacitor element, one end of which is connected to a power source for supplying a voltage having a fixed potential and the other end of which is connected to the gate terminal of the first transistor; and a light emitting element whose cathode is connected to a first power source for supplying a power supply voltage having a potential of a first level or a potential of a second level which is lower than the first level and whose anode is connected to the second terminal of the first transistor, wherein the data driver applies a data signal to the data line during a non-light emission period of one frame in which the light emitting element emits no light, and applies the power supply voltage having the potential of the first level to the data line during a light emission period of one frame in which the light emitting element emits light in response to the data signal, and the potential of the power supply voltage supplied from the first power source is fixed during the non-light emission period, and is changed from the potential of the first level to the potential of the second level during the light emission period.

By this configuration, a pixel may include three transistors and one capacitor element, and variations in the threshold voltage of the first transistor serving as a driving transistor may be compensated for.

Accordingly, the number of elements constituting the pixel circuit can be reduced, and high picture quality can be achieved.

The non-light emission period for each of the pixel circuits constituting the display unit may be synchronized with the light emission period for each of the pixel circuits constituting the display unit.

The data driver may alternately apply a data signal for a right-eye image of a stereoscopic image and a data signal for a left-eye image of the stereoscopic image during one frame period.

The display unit may have data lines which correspond to columns of pixel circuits arranged in a matrix and include a first data line to which a first data signal is applied and a second data line to which a second data signal is applied, and the first terminal of the first transistor of the pixel circuit may be connected to either the first data line or the second data line.

The pixel circuits of the odd-numbered rows of the display unit may be connected to either the first data line or the second data line, and the pixel circuits of the even-numbered rows of the display unit may be connected to either the first data line or the second data line.

The data driver may apply a data signal or the power supply voltage having the potential of the first level to the first data line every horizontal scan period, and may apply the power supply voltage having the potential of the first level to the second data line, in synchronization with the application of the data signal to the first data line, and apply the data signal to the second data line, in synchronization with the application of the power supply voltage having the potential of the first level to the first data line.

The data driver may apply a data signal to the second data line, in synchronization with the application of the data signal to the first data line, and may apply the power supply voltage having the potential of the first level to the second data line, in synchronization with the application of the power supply voltage having the potential of the first level to the first data line.

The data driver may switch between a first driving mode and a second driving mode in response to a switching signal, and in the first driving mode, the data driver may apply a data signal to the second data line, in synchronization with the application of the data signal to the first data line and apply the power supply voltage having the potential of the first level to the second data line, in synchronization with the application of the power supply voltage having the potential of the first level to the first data line, and in the second driving mode, the data driver may apply a data signal or the power supply voltage having the potential of the first level to the first data line every horizontal scan period, in synchronization with the application of the power supply voltage having the potential of the first level to the first data line and apply a data signal to the second data line, in synchronization with the application of the power supply voltage having the potential of the first level to the first data line.

Accordingly, the number of elements constituting the pixel circuit can be reduced, and high picture quality can be achieved.

DETAILED DESCRIPTION OF THE EMBODIMENTS

Figure 1:
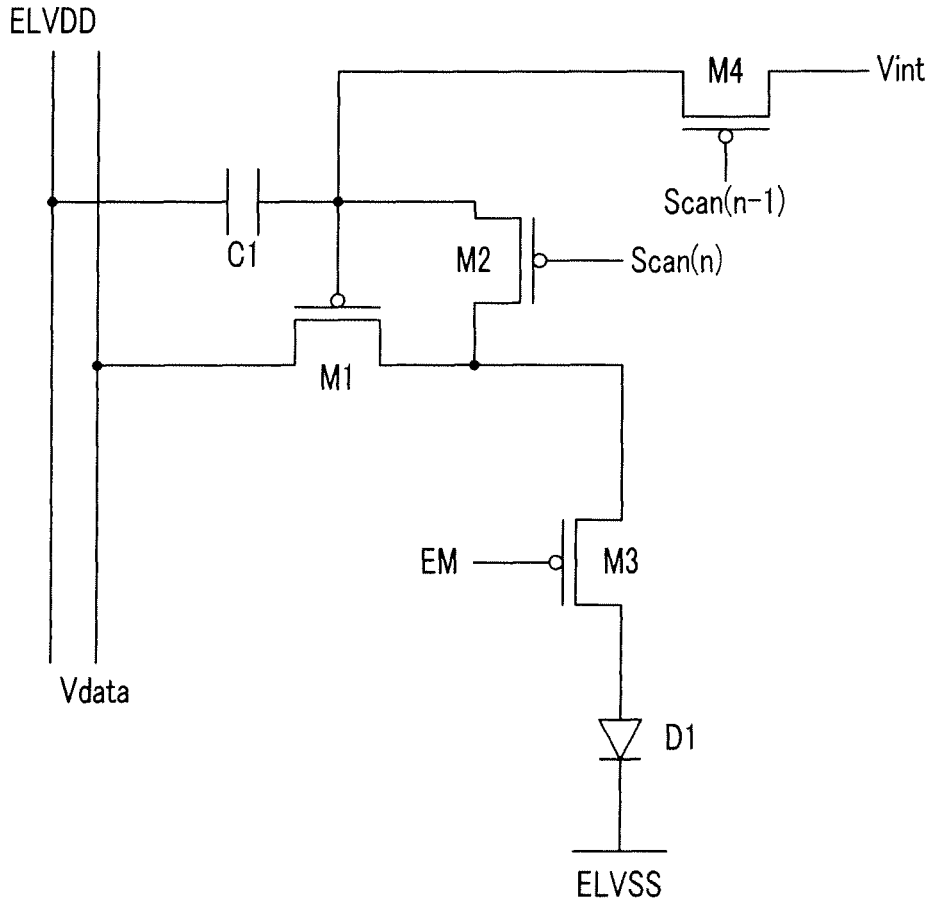
FIG. 1 is an explanatory view showing an example of the configuration of a pixel circuit according to a first exemplary embodiment of the present invention.

Hereinafter, an exemplary embodiment of the present invention will be described in detail with reference to the attached drawings.

In the present specification and drawings, components having substantially the same functional configurations are denoted by the same reference numerals and a repeated description will be omitted.

(Configuration of Pixel Circuit According to the Conventional Art and Method for Compensating for Variations in the Characteristics of Transistor)

Prior to describing the configuration of a pixel circuit according to an exemplary embodiment of the present invention and the configuration of a display device having a pixel circuit according to an exemplary embodiment of the present invention, an example of the configuration of a pixel circuit according to the conventional art and an example of a method for compensating for variations in the characteristics of a transistor according to the conventional art will be described.

Figure 11:
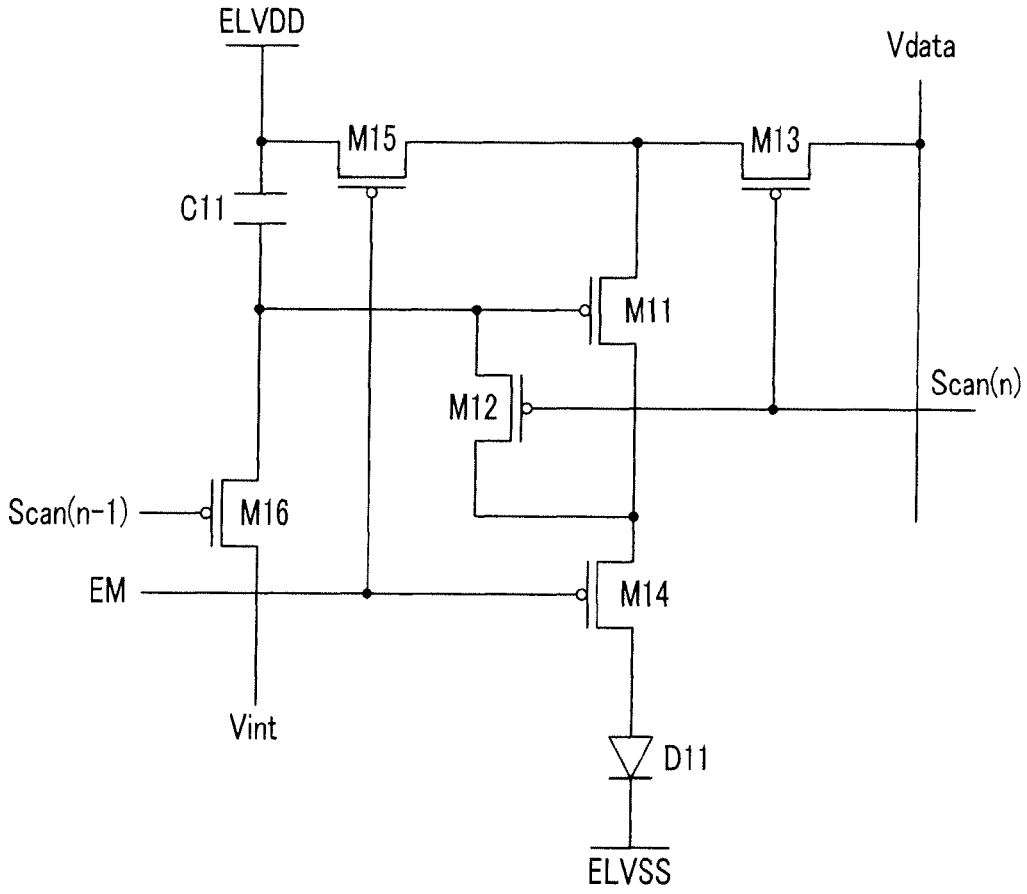
FIG. 11 is an explanatory view showing an example of the configuration of a pixel circuit according to the conventional art.
Figure 12:
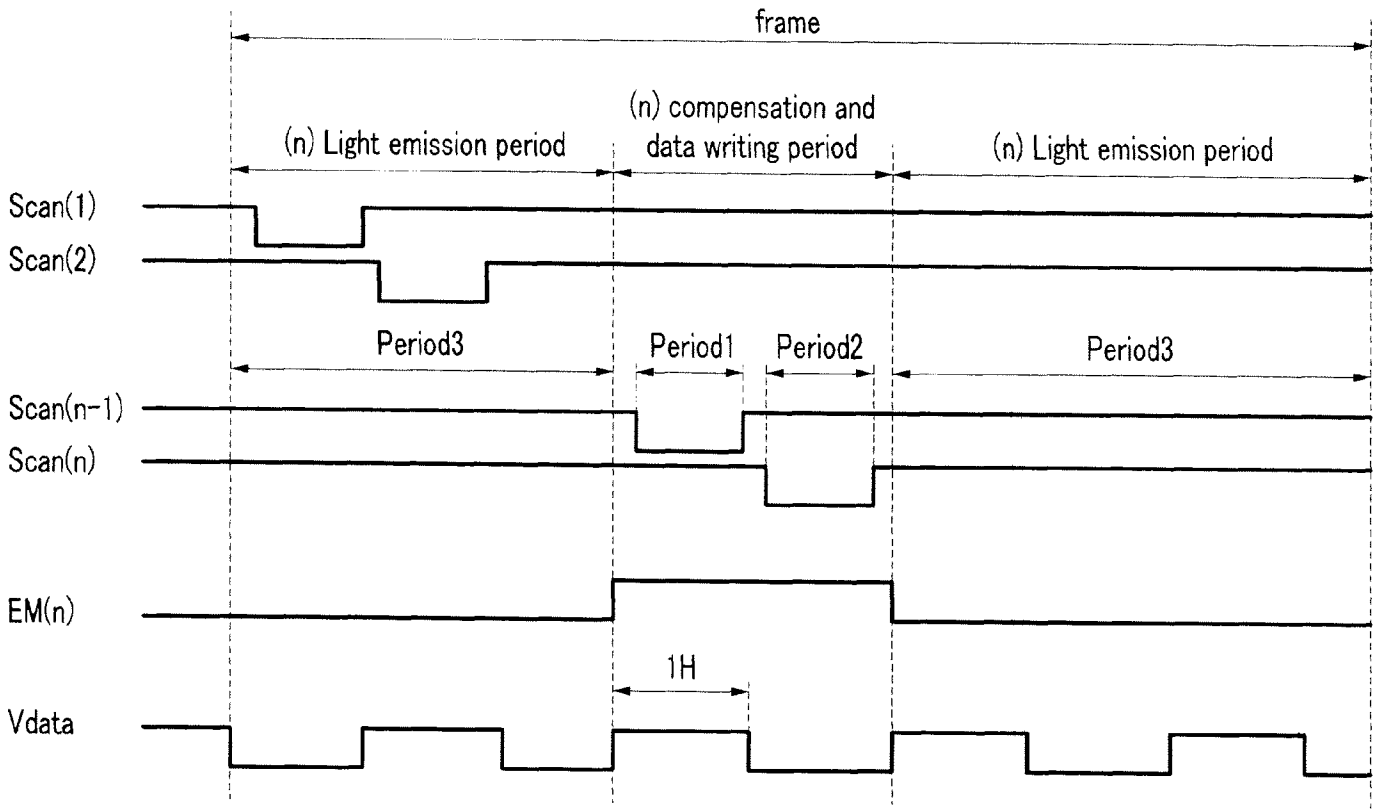
FIG. 12 is an explanatory view showing an example of a method for compensating for variations in the characteristics of a transistor according to the conventional art.

FIG. 11 is an explanatory view showing an example of the configuration of a pixel circuit according to the conventional art. FIG. 12 is an explanatory view showing an example of a method for compensating for variations in the characteristics of a transistor according to the conventional art.

FIG. 12 depicts a variety of signals for driving the pixel circuit of FIG. 11, which correspond to one frame period.

The conventional pixel circuit of FIG. 11 includes a transistor M11 serving as a driving transistor, transistors M12, M13, and M16 serving as switching transistors, transistors M4 and M5 serving as light emission control transistors (emission transistors), a capacitor element C11 (storage capacitor), and a light emitting element D11 (organic EL element) serially connected to the light emission control transistor M14.

ELVDD shown in FIG. 11 is a voltage which is connected to the anode of the light emitting element D11 during a light emission period, and ELVSS shown in FIG. 11 is a voltage which is connected to the cathode of the light emitting element D11.

Vint applied to the transistor M16 is an initialization voltage which initializes the transistor M11 to a desired potential.

In FIG. 11, each of the transistors M11 to M16 is a P-channel type transistor, and each transistor is selectively conducted in response to control signals (scan signals Scan(n−1) and Scan(n) and a light emission control signal EM) applied to a gate terminal.

As shown in FIG. 11, the conventional pixel circuit includes six transistors and one capacitor element.

Next, referring to FIG. 12, an operation of the conventional pixel circuit of FIG. 11 will be described.

A variety of signals for driving a pixel circuit (including both the conventional pixel circuit and a pixel circuit according to an exemplary embodiment of the present invention) are described hereinafter to be voltage signals representing low and high logic levels.

Hereinafter, the conduction of a transistor may indicate that a transistor turns on or is turned on, and the non-conduction of a transistor may indicate that a transistor turns off or is turned off.

In the conventional pixel circuit, during a first period, the scan signal Scan(n−1) becomes low level to cause the transistor M16 to turn on, whereby the potential of the gate terminal of the transistor M11 is initialized to a potential having the voltage Vint.

Next, in the conventional pixel circuit, during a second period, the scan signal Scan(n) becomes low level to cause the transistors M12 and M13 to turn on.

As the transistors M12 and M13 are turned on, a data signal Vdata is applied to the gate terminal of the transistor M11 through the transistor M13, the transistor M11, and the transistor M12.

Regarding the connection relationship between the transistor M11 and the transistor M12, the gate terminal of the transistor M11 is diode-connected to the drain terminal thereof.

Accordingly, the voltage Vgate shown in the following Equation 1 is written to the gate terminal of the transistor M11, and charge corresponding to the voltage is stored in the capacitor element C11.

Vgate of Equation 1 denotes the voltage to be written to the gate terminal of the transistor M11. Thus, Vdata of Equation 1 denotes a voltage represented by the data signal Vdata.

Vth of Equation 1 denotes a threshold voltage representing the threshold value of a voltage at which the transistor M11 becomes conductive.

$$Vgate = Vdata - Vth \quad \text{Equation 1}$$

In the conventional pixel circuit, during a third period, the transistors M12 and M13 are turned off, and the light emission control signal becomes low level so that the transistors M14 and M15 are turned on.

At this point, the voltage of both ends of the capacitor element C11 is equal to a voltage Vgs between the gate and source terminals of the transistor M11 (driving transistor). The voltage corresponding to the charge stored in the capacitor element C11 causes a bias current to flow through the transistor M1, and the bias current flows from a power source supplying the voltage ELVDD to the light emitting element D11 through the transistor M15, the transistor M11, and the transistor M14.

For example, current I flowing through the transistor M11 is represented by the following Equation 2 when it is in a saturated state.

"β" of Equation 2 denotes a coefficient determined by the size, etc of the transistor M11, and "Vgs" of Equation 2 denotes a voltage between the gate and source terminals of the transistor M11.

"Vth" of Equation 2 is a threshold voltage of the transistor M11.

$$I = \beta(Vgs - Vth)2 \quad \text{Equation 2}$$

The voltage Vgs of Equation 2 is represented by the following Equation 3.

$$Vgs = ELVDD - (Vdata - Vth) \quad \text{Equation 3}$$

Based on Equations 2 and 3, the current flowing through the light emitting element D11 (current supplied to the light emitting element D11) is represented by the following Equation 4.

$$\begin{aligned} I &= \beta(ELVDD - Vdata + Vth - Vth)2 \quad \text{Equation 4} \\ &= \beta(ELVDD - Vdata)2 \end{aligned}$$

As shown in Equation 4, the threshold voltage Vth of the transistor M11 is offset.

That is, the current flowing through the light emitting element D11 is not dependent upon the threshold voltage Vth of the transistor M11.

Therefore, a conventional display device (e.g., display device having conventional pixel circuits in a matrix form) having a plurality of conventional pixel circuits of FIG. 11 is able to control the amount of current flowing through the light emitting element D11 only by the data signal Vdata, without depending upon, if any, variations in the threshold voltage of the transistor M11 of each pixel circuit.

In the conventional pixel circuit, variations in the threshold voltage of the driving transistors (e.g., transistor M11) are compensated for in response to the variety of signals shown in FIG. 12.

By using the conventional pixel circuit of FIG. 11, it is possible to prevent display non-uniformity which may occur due to variations in the threshold voltage Vth of the driving transistor. Accordingly, the display uniformity of a conventional display device (e.g., active matrix organic EL display) can be improved.

Therefore, a conventional display device using the conventional pixel circuit can attain high picture quality.

Although the conventional pixel circuit of FIG. 11 requires six transistors within one pixel, a pixel circuit configuration requiring six transistors may become an obstacle to the realization of a high-precision display panel, such as an AMOLED (Active Matrics Organic Light Emitting Diode) panel. More specifically, if the number of pixels on the same size display panel is increased, the area per pixel becomes smaller. This may lead to problems including that the layout of a pixel within a predetermined area cannot be designed because a large number of transistors are required for one pixel.

Therefore, to realize a high-quality and high-precision display panel, it is necessary to implement the function of compensating for variations in the threshold voltage of the driving transistor by using fewer transistors than the conventional pixel circuit.

(Pixel Circuit According to Exemplary Embodiment of the Present Invention)

Hereinafter, description will be made on the configuration of a pixel circuit according to an exemplary embodiment of the present invention which can implement the function of compensating for variations in the threshold voltages Vth of the driving transistor by using fewer transistors than the conventional pixel circuit.

Description will be made below with respect to an example in which the pixel circuit according to the exemplary embodiment of the present invention includes only P-channel type transistors. However, the channel type of transistors is merely an example for describing the configuration of a pixel circuit according to the exemplary embodiment of the present invention. The configuration of a pixel circuit according to the exemplary embodiment of the present invention is not limited to P-channel type transistors.

For example, a pixel circuit according to the exemplary embodiment of the present invention may be implemented as N-channel type transistors, or as a combination of P- and N-channel type transistors.

If the pixel circuit according to the exemplary embodiment of the present invention is implemented as N-channel type transistors, or as a combination of P- and N-channel type transistors, the signal levels of a variety of signals for driving the pixel circuit, which are to be described later, may be changed corresponding to the electrical conduction type of transistors.

[1] Pixel Circuit According to First Exemplary Embodiment

Figure 2:
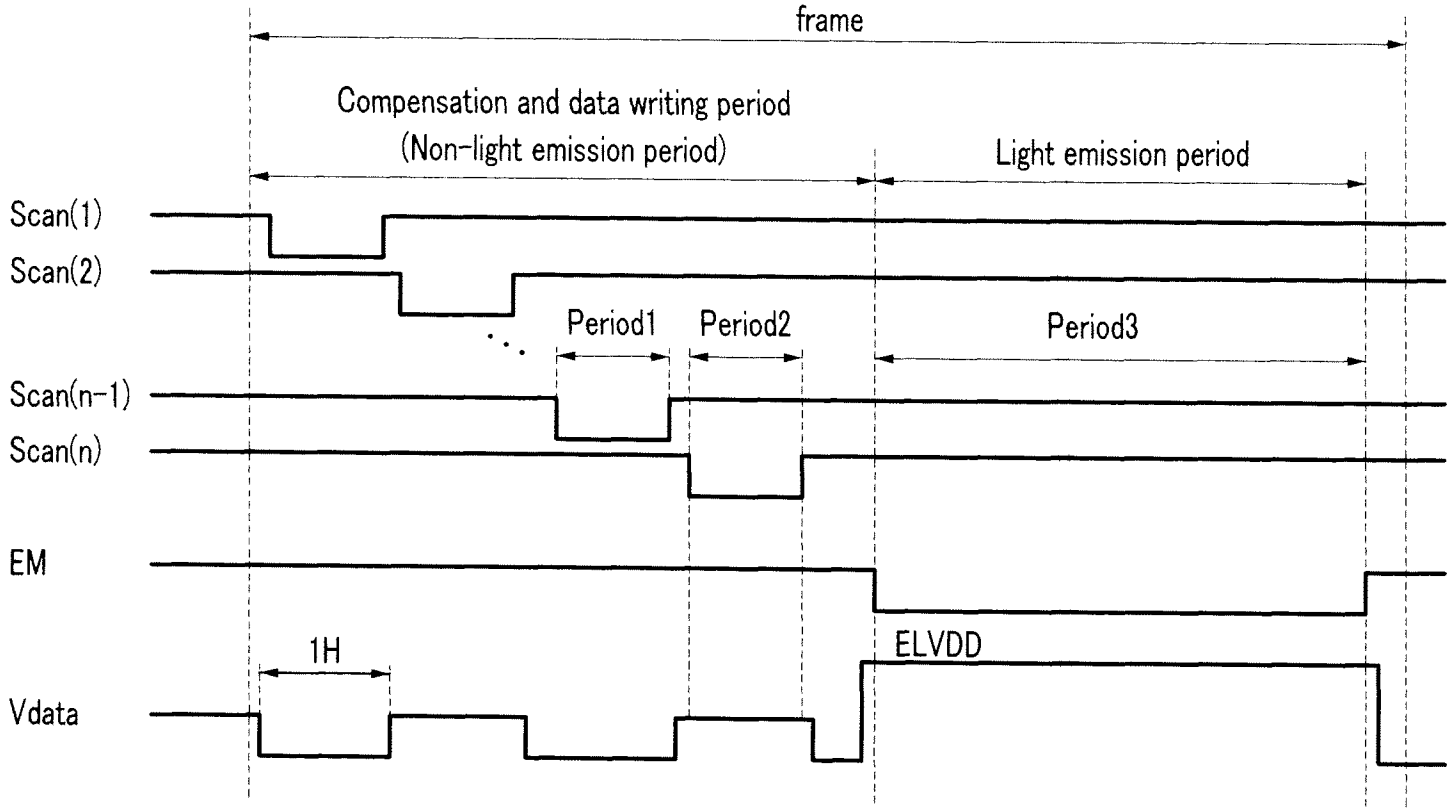
FIG. 2 is an explanatory view showing an example of a method for driving the pixel circuit according to the first exemplary embodiment of the present invention.

FIG. 1 is an explanatory view showing an example of the configuration of a pixel circuit according to a first exemplary embodiment of the present invention. FIG. 2 is an explanatory view showing an example of a method for driving the pixel circuit according to the first exemplary embodiment of the present invention.

FIG. 2 depicts a variety of signals for driving the pixel circuit of FIG. 1, which correspond to one frame period.

The pixel circuit according to the first exemplary embodiment includes a light emitting element D1 (organic EL element), a transistor M1 (first transistor) serving as a driving transistor, a transistor M2 (second transistor) serving as a switching transistor, a transistor M3 (third transistor) serving as a light emission control transistor (emission transistor), a transistor (fourth transistor) serving as a switching transistor, and a capacitor element C1 (storage capacitor).

The light emitting element D1 includes a cathode connected to a power source (first power source) supplying a power supply voltage ELVSS (first power supply voltage).

The power source supplying the power supply voltage ELVSS is a power source at the cathode of the light emitting element D1.

The transistor M1 includes a first terminal connected to a data line, and is selectively conducted in response to a voltage applied to the gate terminal.

The transistor M2 is connected between the gate terminal of the transistor M1 and a second terminal of the transistor M1, and is selectively conducted based on a first scan signal Scan(n) applied to the gate terminal.

The transistor M3 is connected between the second terminal of the transistor M1 and the anode of the light emitting element D1, and is selectively conducted in response to a light emission control signal EM applied to the gate terminal.

The transistor M4 is connected between the gate terminal of the transistor M1 and an initialization power source supplying a voltage Vint, and is selectively conducted in response to a second scan signal Scan(n−1) applied to the gate terminal.

The capacitor element C1 includes one end connected to the power source (second power source) supplying a power supply voltage ELVDD (second power supply voltage) and the other end connected to the gate terminal of the transistor M1.

Here, the power source supplying the power supply voltage ELVDD is a power source at the anode of the light emitting element D1.

The relationship between the power supply voltage ELVDD and the power supply voltage ELVSS is represented by power supply voltage ELVDD>power supply voltage ELVSS.

Hereinafter, the potential of the power supply voltage ELVDD may be represented by a potential of a first level, and the potential of the power supply voltage ELVSS, which is lower than the potential of the first level, may be represented by a potential of a second level.

As shown in FIG. 1, the pixel circuit according to the first exemplary embodiment includes four transistors and one capacitor element.

That is, the pixel circuit according to the first exemplary embodiment has two fewer transistors than the conventional pixel circuit shown in FIG. 11.

Next, referring to FIG. 2, an operation of the pixel circuit of FIG. 1 according to the first exemplary embodiment will be described.

As shown in FIG. 2, one frame has a non-light emission period in which the light emitting element D1 emits no light and a light emission period in which the light emitting element D1 emits light in response to a data signal applied to a data signal after lapse of the non-light emission period.

Examples of the data signal according to the exemplary embodiment of the present invention may include an image signal for displaying an image (motion image or still image).

Hereinafter, description will be made with respect to an example in which the data signal according to the exemplary embodiment of the present invention is an image signal.

During a first period of the non-light emission period, the second scan signal Scan(n−1) becomes low level to cause the transistor M4 to turn on, whereby the potential of the gate terminal of the transistor M1 is initialized to a potential having the voltage Vint.

Next, during a second period after the first period of the non-light emission period, the first scan signal Scan(n) becomes low level to cause the transistor M2 to turn on, whereby the data signal Vdata applied to the data line is applied to the gate terminal of the transistor M1 through the transistor M1 and the transistor M2.

Regarding the connection relationship between the transistor M1 and the transistor M2, the gate terminal of the transistor M1 is diode-connected to the second terminal thereof.

Accordingly, the voltage Vgate shown in the following Equation 5 is written to the gate terminal of the transistor M1, and charge corresponding to the voltage is stored in the capacitor element C1.

Vgate of Equation 5 denotes the voltage to be written to the gate terminal of the transistor M1, and Vdata of Equation 5 denotes a voltage represented by the data signal Vdata.

Vth of Equation 5 denotes a threshold voltage representing the threshold value of a voltage at which the transistor M1 becomes conductive.

$$Vgate=Vdata-Vth \quad \text{Equation 5}$$

Here, the transistor M1 (driving transistor) of the pixel circuit of FIG. 1 of the first exemplary embodiment is directly connected to the data line, unlike the conventional pixel circuit shown in FIG. 11.

However, the transistor M3 is OFF during the non-light emission period, so that the current corresponding to the data signal Vdata does not flow through the light emitting element D1, and the potential of the gate terminal of the transistor M1 is not updated unless the transistor M2 is turned on.

That is, as the transistor M2 of the pixel circuit of the first exemplary embodiment turns on during the second period of the non-light emission period for each frame, an image displayed in response to the data signal is updated.

During a third period corresponding to the light emission period, the light emission signal EM becomes low level, and the transistor M3 is turned on.

During the third period, the second power supply voltage ELVDD is applied to the data line, and the potential of the data line is maintained as the potential of the second power supply voltage ELVDD.

At this point, the voltage of both ends of the capacitor element C1 is equal to a voltage Vgs between the gate terminal and first terminal (source terminal) of the transistor M1.

The voltage stored in the capacitor element C1 causes a bias current to be supplied from the data line to the light emitting element D1 through the transistor M1 and the transistor M3.

Like the current flowing through the transistor M11 of the conventional pixel circuit shown in FIG. 11, the current flowing through the transistor M1 can be represented by the following Equation 6 when it is in a saturated state.

"β" of Equation 6 denotes a coefficient determined by the size, etc of the transistor M1, and "Vgs" of Equation 6 denotes a voltage between the gate terminal and first terminal (source terminal) of the transistor M1.

"Vth" of Equation 6 is a threshold voltage of the transistor M1.

$$I=\beta(Vgs-Vth)2 \quad \text{Equation 6}$$

The voltage Vgs of Equation 6 is represented by the following Equation 7.

$$Vgs=ELVDD-(Vdata-Vth) \quad \text{Equation 7}$$

Based on Equations 6 and 7, the current flowing through the light emitting element D1 (current supplied to the light emitting element D1) is represented by the following Equation 8.

$$\begin{aligned} I &= \beta(ELVDD - Vdata + Vth - Vth)2 \\ &= \beta(ELVDD - Vdata)2 \end{aligned} \quad \text{Equation 8}$$

As shown in Equation 8, the threshold voltage Vth of the transistor M1 is offset.

That is, the current flowing through the light emitting element D1 is not dependent upon the threshold voltage Vth of the transistor M1.

As such, the pixel circuit according to the first exemplary embodiment is able to control the amount of current flowing through the light emitting element D1 by the data signal Vdata because variations in the threshold voltage Vth of the transistor M1 are compensated for in accordance with operations of the variety of signals shown in FIG. 2. That is, variations in the threshold voltage Vth of the driving transistor of the pixel circuit according to the first exemplary embodiment can be compensated for, like the conventional pixel circuit shown in FIG. 11.

By using the pixel circuit according to the first exemplary embodiment, it is possible to prevent display non-uniformity which may occur due to variations in the threshold voltage Vth of the driving transistor.

Accordingly, the display uniformity of a display device (e.g., active matrix organic EL display) can be improved with the use of the pixel circuit according to the first exemplary embodiment.

Also, the pixel circuit according to the first exemplary embodiment has two fewer transistors than the conventional pixel circuit.

Therefore, the pixel circuit according to the first exemplary embodiment can have a reduced number of elements constituting the pixel circuit and achieve high picture quality.

Since the pixel circuit according to the first exemplary embodiment has a reduced number of elements constituting the pixel circuit, and is therefore advantageous in realizing a high-precision display panel, compared to the conventional pixel circuit.

The configuration of the pixel circuit according to the first exemplary embodiment is not limited to the configuration of FIG. 1.

For example, although FIG. 1 illustrates that one end of the capacitor element C1 is connected to the power source (second power source) supplying the power supply voltage (second power supply voltage), the exemplary embodiment of the present invention is not limited to this configuration.

That is, one end of the capacitor element C1 of the pixel circuit may be connected, not to the power source supplying the power supply voltage ELVDD, but to a different power source supplying a voltage having a fixed potential.

Figure 3:
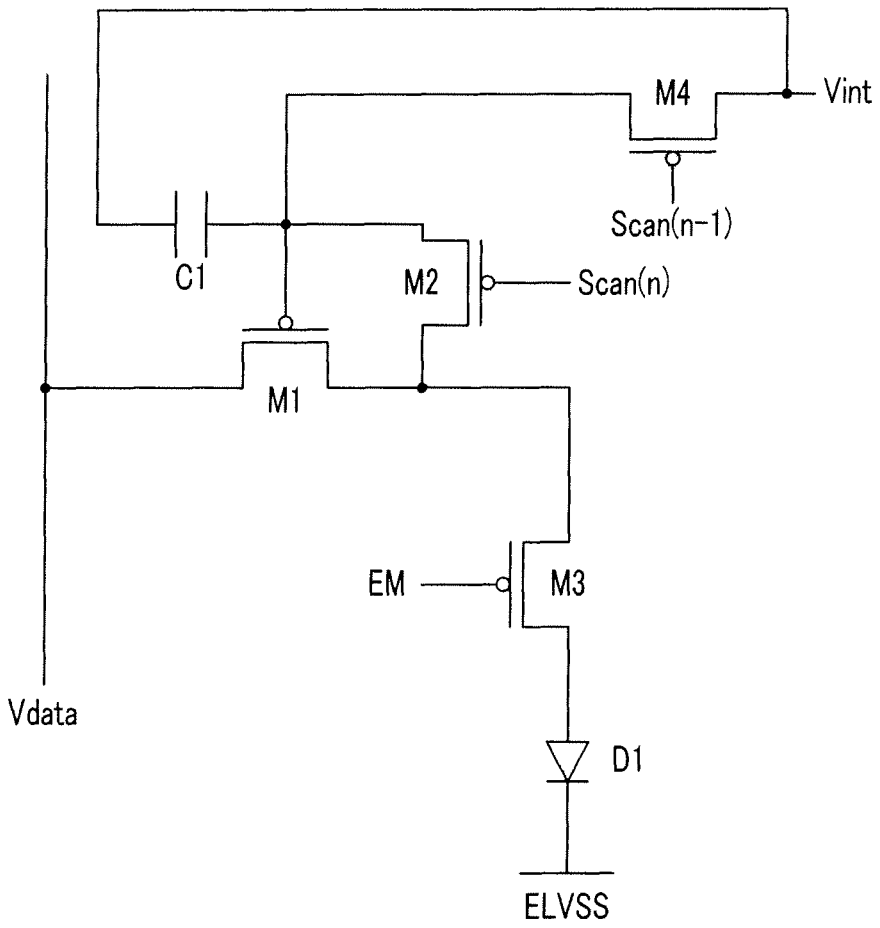
FIG. 3 is an explanatory view showing an example of the configuration of a pixel circuit according to a modification of the first exemplary embodiment of the present invention.

FIG. 3 is an explanatory view showing an example of the configuration of a pixel circuit according to a modification of the first exemplary embodiment of the present invention.

Although they basically have the same configuration, the pixel circuit of FIG. 3 according to the modification is different from the pixel circuit shown in FIG. 1 in that one end of the capacitor element C1 is connected to an initialization power source.

Here, the potential of an initialization voltage Vint supplied by the initialization power source is fixed.

Accordingly, the pixel circuit of FIG. 3 according to the modification performs the same operation as the pixel circuit shown in FIG. 1 by applying the variety of signals shown in FIG. 2 during one frame period.

Therefore, the pixel circuit of FIG. 3 according to the modification may have the same effect as the pixel circuit shown in FIG. 1.

Moreover, one end of the capacitor element C1 is connoted to the initialization power source. Hence, the pixel circuit of FIG. 3 according to the modification does not require the power supply line for supplying the power supply voltage ELVDD in the pixel circuit of FIG. 1.

As no power supply line is required, wiring space of the display panel can be eliminated. In this regard, the modification of FIG. 3 is advantageous in realizing a high-precision display panel.

As a result, the degree of freedom in the layout of a display panel is improved with the use of the pixel circuit of FIG. 3 according to the modification (i.e., the modification of FIG. 3 is advantageous in terms of layout).

In the pixel circuit according to the modification of the first exemplary embodiment, the power source supplying a fixed voltage to which one end of the capacitor element C1 is not limited to the initialization power source.

[2] Pixel Circuit According to Exemplary Embodiment

As shown in FIGS. 1 to 3, the configuration of a pixel circuit according to an exemplary embodiment of the present invention is not limited to the configuration of a pixel circuit having four transistors.

Figure 4:
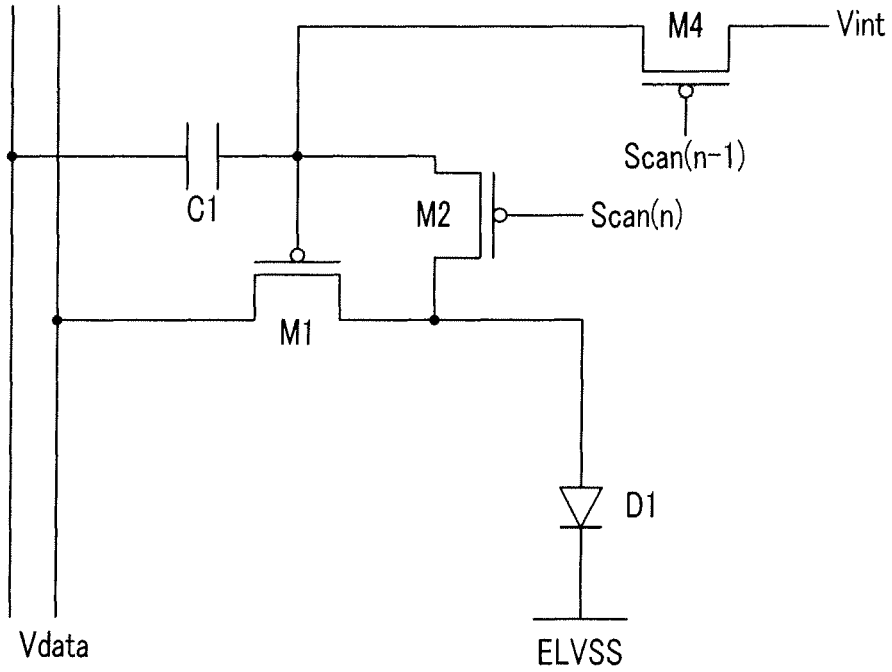
FIG. 4 is an explanatory view showing an example of the configuration of a pixel circuit according to a second exemplary embodiment of the present invention.
Figure 5:
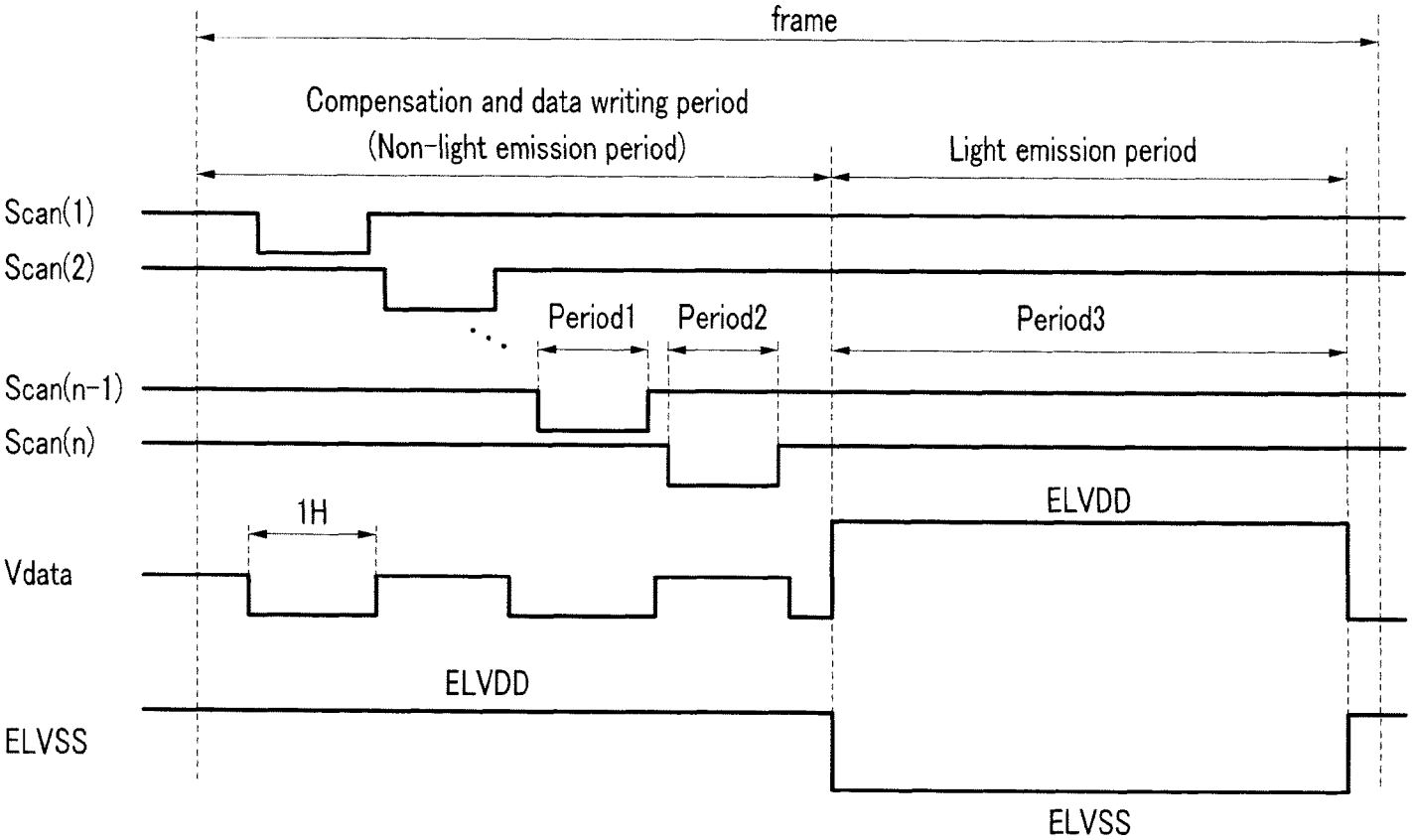
FIG. 5 is an explanatory view showing an example of a method for driving the pixel circuit according to the second exemplary embodiment of the present invention.

FIG. 4 is an explanatory view showing an example of the configuration of a pixel circuit according to a second exemplary embodiment of the present invention. FIG. 5 is an explanatory view showing an example of a method for driving the pixel circuit according to the second exemplary embodiment of the present invention.

FIG. 5 depicts a variety of signals for driving the pixel circuit of FIG. 4, which correspond to one frame period.

The pixel circuit according to the second exemplary embodiment includes a transistor M1 (first transistor) serving as a driving transistor, a transistor M2 (second transistor) serving as a switching transistor, a transistor (fourth transistor) serving as a switching transistor, a capacitor element C1 (storage capacitor), and a light emitting element D1 (organic EL element).

The transistor M1 includes a first terminal connected to a data line, and is selectively conducted in response to a voltage applied to the gate terminal.

The transistor M2 is connected between the gate terminal of the transistor M1 and a second terminal of the transistor M1, and is selectively conducted based on a first scan signal Scan(n) applied to the gate terminal.

The transistor M4 is connected between the gate terminal of the transistor M1 and an initialization power source supplying a voltage Vint, and is selectively conducted in response to a second scan signal Scan(n−1) applied to the gate terminal.

One end of the capacitor element C1 is connected to the power source (second power source) supplying a power supply voltage ELVDD (second power supply voltage), and the other end thereof is connected to the gate terminal of the transistor M1.

The light emitting element D1 includes a cathode connected to a power source and an anode connected to the second terminal of the first transistor M1.

Here, a potential supplied from the power source connected to the cathode of the light emitting element D1 is not fixed, and, for example, a power supply voltage ELVDD having a potential of a first level or a power supply voltage ELVSS having a potential of a second level is supplied from the power source connected to the cathode of the light emitting element D1.

As shown in FIG. 4, the pixel circuit according to the second exemplary embodiment is equivalent to a circuit in which the transistor M3 included in the pixel circuit according to the first exemplary embodiment, as shown in FIG. 1, is omitted.

The pixel circuit according to the second exemplary embodiment includes three transistors and one capacitor element. That is, the pixel circuit according to the second exemplary embodiment has three fewer transistors than the conventional pixel circuit shown in FIG. 11.

Next, referring to FIG. 5, an operation of the pixel circuit of FIG. 4 according to the second exemplary embodiment will be described.

As shown in FIG. 5, one frame has a non-light emission period in which the light emitting element D1 emits no light and a light emission period in which the light emitting element D1 emits light in response to a data signal applied to a data signal after lapse of the non-light emission period.

As shown in FIG. 5, during the non-light emission period, the power source connected to the cathode of the light emitting diode D1 supplies the power supply voltage ELVDD.

Accordingly, during the non-light emission period, the light emitting D1 is turned off.

During a first period of the non-light emission period, the second scan signal Scan(n−1) becomes low level to cause the transistor M4 to turn on, whereby the potential of the gate terminal of the transistor M1 is initialized to a potential having the voltage Vint.

Next, during a second period after the first period of the non-light emission period, the first scan signal Scan(n) becomes low level to cause the transistor M2 to turn on, whereby the data signal Vdata applied to the data line is applied to the gate terminal of the transistor M1 through the transistor M1 and the transistor M2.

Regarding the connection relationship between the transistor M1 and the transistor M2, the gate terminal of the transistor M1 is diode-connected to the second terminal thereof.

Accordingly, the voltage Vgate shown in the following Equation 9 is written to the gate terminal of the transistor M1, and charge corresponding to the voltage is stored in the capacitor element C1.

Vgate of Equation 9 denotes the voltage to be written to the gate terminal of the transistor M1, and Vdata of Equation 9 denotes a voltage represented by the data signal Vdata.

Vth of Equation 9 denotes a threshold voltage representing the threshold value of a voltage at which the transistor M1 becomes conductive.

$$V\text{gate}=V\text{data}-Vth \qquad \text{Equation 9}$$

Here, the transistor M1 (driving transistor) of the pixel circuit of FIG. 4 of the second exemplary embodiment is directly connected to the data line, like the pixel circuit of FIG. 1 according to the first exemplary embodiment.

However, the light emitting diode D1 is OFF during the non-light emission period, so that the current corresponding to the data signal Vdata does not flow through the light emitting element D1. Also, the potential of the gate terminal of the transistor M1 is not updated unless the transistor M2 is turned on.

That is, as the transistor M2 of the pixel circuit of the second exemplary embodiment turns on during the second period of the non-light emission period for each frame, an image displayed in response to the data signal is updated.

During a third period corresponding to the light emission period, the power source connected to the cathode of the light emitting diode D1 supplies the power supply voltage ELVSS.

That is, the potential of the voltage applied to the cathode of the light emitting element D1 may change from the potential of the first level to the potential of the second level.

During the third period, the second power supply voltage ELVDD is applied to the data line, and the potential of the data line is maintained as the potential of the second power supply voltage ELVDD (potential of the first level).

At this point, the voltage of both ends of the capacitor element C1 is equal to a voltage Vgs between the gate terminal and first terminal (source terminal) of the transistor M1.

The voltage stored in the capacitor element C1 causes a bias current to be supplied from the data line to the light emitting element D1 through the transistor M1.

Like the current flowing through the transistor M11 of the conventional pixel circuit shown in FIG. 11, the current flowing through the transistor M1 can be represented by the following Equation 10 when it is in a saturated state.

"β" of Equation 10 denotes a coefficient determined by the size, etc of the transistor M1, and "Vgs" of Equation 10 denotes a voltage between the gate terminal and first terminal (source terminal) of the transistor M1.

"Vth" of Equation 10 is a threshold voltage of the transistor M1.

$$I=\beta(Vgs-Vth)2 \quad \text{Equation 10}$$

The voltage Vgs of Equation 10 is represented by the following Equation 11.

$$Vgs=ELVDD-(V\text{data}-Vth) \quad \text{Equation 11}$$

Based on Equations 10 and 11, the current flowing through the light emitting element D1 (current supplied to the light emitting element D1) is represented by the following Equation 12.

$$I=\beta(ELVDD-Vdata+Vth-Vth)2 \quad \text{Equation 12}$$

$$=\beta(ELVDD-Vdata)2$$

As shown in Equation 12, the threshold voltage Vth of the transistor M1 is offset.

That is, the current flowing through the light emitting element D1 is not dependent upon the threshold voltage Vth of the transistor M1.

As such, the pixel circuit according to the second exemplary embodiment is able to control the amount of current flowing through the light emitting element D1 by the data signal Vdata because variations in the threshold voltage Vth of the transistor M1 are compensated for in accordance with operations of the variety of signals shown in FIG. 5.

As described above, variations in the threshold voltage Vth of the driving transistor of the pixel circuit according to the second exemplary embodiment can be compensated for, like the conventional pixel circuit shown in FIG. 11.

By using the pixel circuit according to the second exemplary embodiment, it is possible to prevent display non-uniformity which may occur due to variations in the threshold voltage Vth of the driving transistor.

Accordingly, the display uniformity of a display device (e.g., active matrix organic EL display) can be improved with the use of the pixel circuit according to the second exemplary embodiment.

Also, the pixel circuit according to the second exemplary embodiment has three fewer transistors than the conventional pixel circuit.

Therefore, the pixel circuit according to the second exemplary embodiment can have a reduced number of elements constituting the pixel circuit and achieve high picture quality.

Since the pixel circuit according to the second exemplary embodiment has a reduced number of elements constituting the pixel circuit, and is therefore advantageous in realizing a high-precision display panel, compared to the conventional pixel circuit.

The configuration of the pixel circuit according to the second exemplary embodiment is not limited to the configuration of FIG. 4.

For example, like the pixel circuit according to the first exemplary embodiment, the pixel circuit according to the second exemplary embodiment may be configured such that one end of the capacitor element C1 is connected to a power source supplying a voltage having a fixed potential.

Although an example of the power source supplying a voltage having a fixed potential may include an initialization power source, like in the pixel circuit of FIG. 3 according to the modification of the first exemplary embodiment, the power source supplying a voltage having a fixed potential is not limited to the initialization power source.

If one end of the capacitor element C1 of the pixel circuit according to the second exemplary embodiment is connected to the initialization power source, like the pixel circuit of FIG. 3 according to the modification of the first exemplary embodiment, the pixel circuit of FIG. 4 does not require the power supply line for supplying the power supply voltage ELVDD. Therefore, the pixel circuit according to the second exemplary embodiment may have the same effect as the pixel circuit of FIG. 3 according to the modification of the first exemplary embodiment.

(Display Device According to Exemplary Embodiment of the Present Invention)

Next, a display device according to an exemplary embodiment of the present invention to which the pixel circuit according to an exemplary embodiment of the present invention is applicable will be described.

[I] Display Device According to First Exemplary Embodiment

Figure 6:
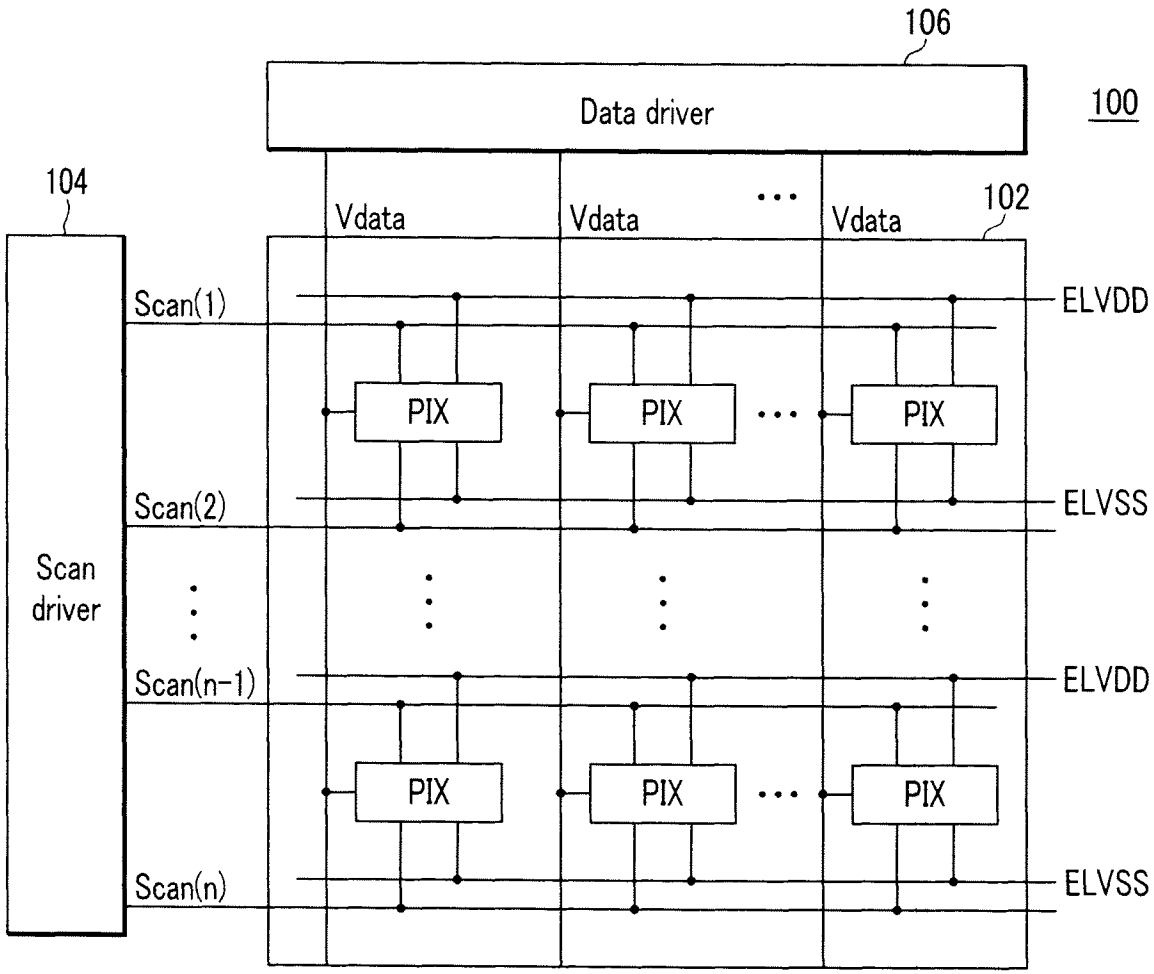
FIG. 6 is an explanatory view showing an example of the configuration of a display device according to the first exemplary embodiment of the present invention.

FIG. 6 is an explanatory view showing an example of the configuration of a display device 100 according to the first exemplary embodiment of the present invention.

The display device 100 includes, for example, a display panel 102 (display unit), a scan driver 104, and a data driver 106.

The display device 100 may also include, for example, a control unit (not shown), a ROM (Read Only Memory; not shown), a RAM (Random Access Memory; not shown), a receiving unit for receiving an image signal transmitted from a broadcasting station or the like, a storage unit (not shown), an operation unit (not shown) operable by the user, a communication unit (not shown), and the like.

The display device 100 connects each configuring elements by a bus serving as a data transmission path.

The control unit (not shown) is configured by an MPU (Micro Processing Unit), various processing circuits, and the like, and controls the entire display device 100.

The control unit (not shown) may serves as a timing controller for controlling the scan driver 104 and the data driver.

The ROM (not shown) stores therein programs to be used by the control unit (not shown) or control data such as operation parameters.

The RAM (not shown) temporarily stores therein programs to be executed by the control unit (not shown).

The storage (not shown) stores therein, for example, various types of data, such as image data, applications, and the like.

The storage unit (not shown) may include a magnetic recording medium such as hard disc, or a non-volatile memory such as EEPROM (Electrically Erasable and Programmable Read Only Memory) and a flash memory.

The storage unit (not shown) may be attachable/detachable to/from the display device 100.

The operation unit (not shown) may be a button, a direction key, or a combination thereof.

The display device 100 is an external device, which may be connected to, for example, an operation input device (e.g., a keyboard or a mouse).

The communication unit (not shown) communicates with an external device through a network (or directly) by wire or wireless communication.

The communication unit (not shown) may include a communication antenna and a RF (Radio Frequency) circuit (wireless communication), an IEEE802.15.1 port and a transmission and reception circuit (wireless communication), an IEEE802.11b port and a transmission and reception circuit (wireless communication), a LAN (Local Area Network) terminal and a transmission and reception circuit (wire communication), or the like.

The network according to an exemplary embodiment of the present invention may include a wired network such as LAN (Local Area network) or WAN (Wide Area Network), a wireless network such as WWAN (Wireless Wide Area Network) or WMAN (Wireless Metropolitan Area Network) via a base station, or Internet using a communication protocol such as TCP/IP (Transmission Control Protocol/Internet Protocol).

The display panel 102 includes data lines and scan lines arranged in a matrix (rows and columns) and pixels PX arranged in a matrix form (rows and columns) so as to correspond to crossing points of the data lines and the scan lines. As shown in FIG. 6, the pixels PIX are arranged in a matrix.

For instance, the display panel 102 displaying an image of SD (Standard Definition) resolution has at least 640×480=307200 (data line×scan line) pixels, and has 640×480×3=921600 (data line×scan line×number of sub-pixels) sub-pixels if the relevant pixel is made up of sub-pixels of R, G, and B for color display.

Similarly, the display displaying an image of HD (High Definition) resolution has 1920×1080 pixels, and has 1920×1080×3 sub-pixels in the case of color display.

Each pixel of the display panel 102 may be, for example, the pixel circuit according to the foregoing first exemplary embodiment (including the modification), or the pixel circuit according to the second exemplary embodiment (including the modification).

The scan driver 104 applies scan signals Scan(1, . . . , Scan(n) to the scan lines.

The scan driver 104 applies scan signals to each scan line in response to a control signal transmitted from the control unit (not shown) serving as, for example, a timing controller.

The data driver 106 applies a data signal Vdata or a power supply voltage ELVDD (second power supply voltage) to the data lines.

More specifically, as shown in FIGS. 2 and 5, the data driver 106 applies the data signal to the data lines during a non-light emission period of one frame, and applies the power supply voltage ELVDD (second power supply voltage) to the data lines during a light emission period of one frame.

Here, the data driver 106 applies the data signal Vdata or the power supply voltage ELVDD in response to a control signal transmitted from the control unit (not shown) serving as, for example, a timing controller.

The display device according to the first exemplary embodiment has the configuration of FIG. 6, for example.

Here, pixel circuits including pixels of the display panel 102 have, for example, the configuration of FIG. 1 or the configuration of FIG. 4, and each pixel circuit operates in response to the variety of signals shown in FIG. 2 or FIG. 5 during each frame period.

By using the method for driving the pixel circuit according to the exemplary embodiment of the present invention shown in FIG. 2 or FIG. 5, the display device 100 sequentially performs initialization of all the pixels of the display panel 102, threshold compensation, and data writing during the non-light emission period (front part) of one frame.

Moreover, by using the method for driving the pixel circuit according to the exemplary embodiment of the present invention shown in FIG. 2 or FIG. 5, all the pixels of the display panel 102 of the display device 100 emit light in synchronization with each other during the light emission period (rear part) of one frame.

That is, by using the method for driving the pixel circuit according to the exemplary embodiment of the present invention shown in FIG. 2 or FIG. 5, the non-light emission period of each of the pixel circuits constituting the display panel 102 of the display device 100 and the light emission period of each of the pixel circuits constituting the display panel 102 of the display device 100 are synchronized with each other.

Hereinafter, a driving mode using the driving method for synchronization of the non-light emission and light emission periods for each of the pixel circuits of the display panel 102 of the display device according to an exemplary embodiment of the present invention may be referred to as 'first driving mode'.

Here, the first driving mode according to an exemplary embodiment of the present invention indicates "simultaneous driving".

An advantage of driving the display device 100 in the first driving mode is that the light emission and non-light emission periods of the light emitting diode (organic EL element) can be time-divisionally separated from each other.

Accordingly, when the display device 100 is driven in the first driving mode, a stereoscopic image with less crosstalk can be displayed on the display screen.

Figure 7:
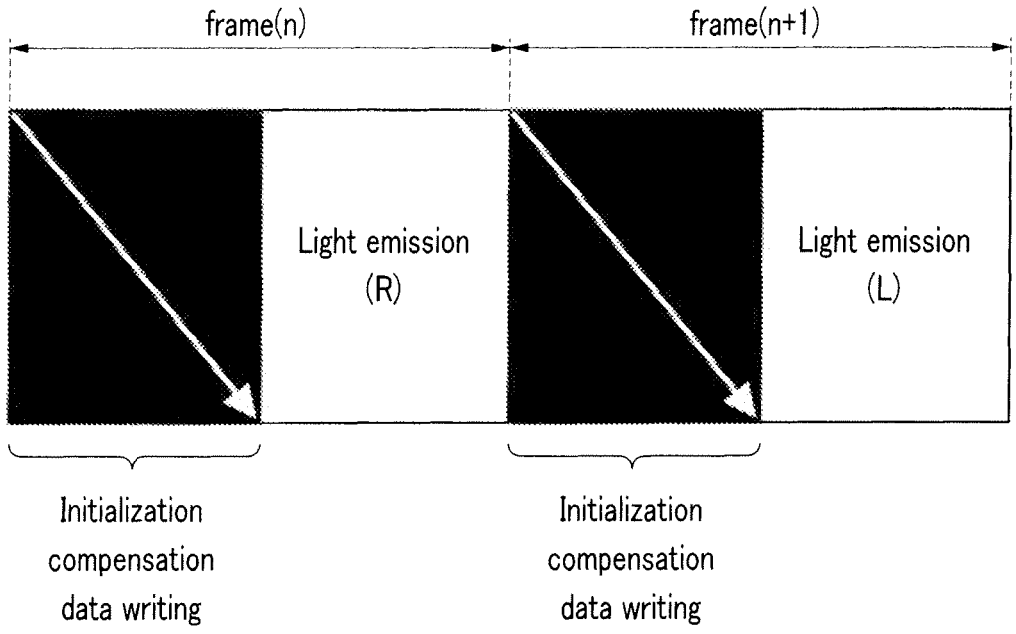
FIG. 7 is an explanatory view for explaining the advantage of driving the display device according to an exemplary embodiment of the present invention in the first driving mode.

FIG. 7 is an explanatory view for explaining the advantage of driving the display device 100 according to an exemplary embodiment of the present invention in the first driving mode.

FIG. 7 depicts the displaying of a stereoscopic image on the display screen. Specifically, FIG. 7 illustrates the first driving mode when the data driver 106 alternately apply a data signal for a right-eye image of the stereoscopic image and a data signal for a left-eye image of the stereoscopic image during one frame period.

During a non-light emission period of an n-th frame (frame (n) shown in FIG. 7), initialization of all the pixels of the display panel 102, threshold compensation, and writing of the data signal for the right-eye image are sequentially performed.

During the non-light emission period of the n-th frame, the light emitting element of each pixel is in the non-light emission state, and the display on the display screen of the display panel 102 looks black.

During the light emission period of the n-th frame, the light emitting element of each pixel emits light in response to the data signal for the right-eye image.

Accordingly, the right-eye image is displayed on the display screen during the light emission period of the n-th frame.

During a non-light emission period of an (n+1)-th frame (frame(n+1) shown in FIG. 7), initialization of all the pixels of the display panel 102, threshold compensation, and writing of the data signal for the left-eye image are sequentially performed.

As stated above, during the non-light emission period of the (n+1)-th frame, the display on the display screen of the display panel 102 looks black.

During the light emission period of the (n+1)-th frame, the light emitting element of each pixel emits light in response to the data signal for the left-eye image.

Accordingly, the left-eye image is displayed on the display screen during the light emission period of the (n+1)-th frame.

As shown in FIG. 7, when the display device 100 is driven in the first driving mode, a black display period can be easily inserted between a period for displaying the right-eye image and a period for displaying the left-eye image.

Accordingly, when the display device 100 is driven in the first driving mode, a stereoscopic image with less crosstalk can be displayed on the display screen.

While an example has been given above of a case where the display device 100 displays a stereoscopic image on the display screen, and the advantage of driving the display device 100 in the first driving mode has been described, it will be obvious that a plan image, but a planar image, as well as a stereoscopic image, can be displayed by driving the display device 100 according to the first exemplary embodiment of the present invention.

As stated above, in the display device 100 according to the first exemplary embodiment of the present invention, each pixel of the display panel 102 is configured as a pixel circuit according to the above-described exemplary embodiments.

Therefore, the display device 100 according to the first exemplary embodiment can have a reduced number of elements constituting the pixel circuit and achieve high picture quality.

Since the display device 100 has a reduced number of elements constituting the pixel circuit, and is therefore advantageous in realizing a high-precision display panel, compared to the conventional display device using the conventional pixel circuit.

By driving the display device according to the first exemplary embodiment in the first driving mode for simultaneous driving, light emission and non-light emission periods of the light emitting element (organic EL element) can be time-divisionally separated from each other.

Accordingly, when the display device 100 is driven in the first driving mode, a stereoscopic image with less crosstalk can be displayed on the display screen.

[II] Display Device According to Second Exemplary Embodiment

The configuration of a display device according to an exemplary embodiment is not limited to the configuration of FIG. 6.

For example, the display panel (display unit) of the display device according to the exemplary embodiment of the present invention may have data lines which correspond to columns of pixel circuits arranged in a matrix and include a first data line to which a first data signal is applied and a second data line to which a second data signal is applied.

If the display panel has the first data line and the second data line, a first terminal of a transistor M1 (first transistor; driving transistor) constituting a pixel circuit is connected to either the first data line or the second data line.

Figure 8:
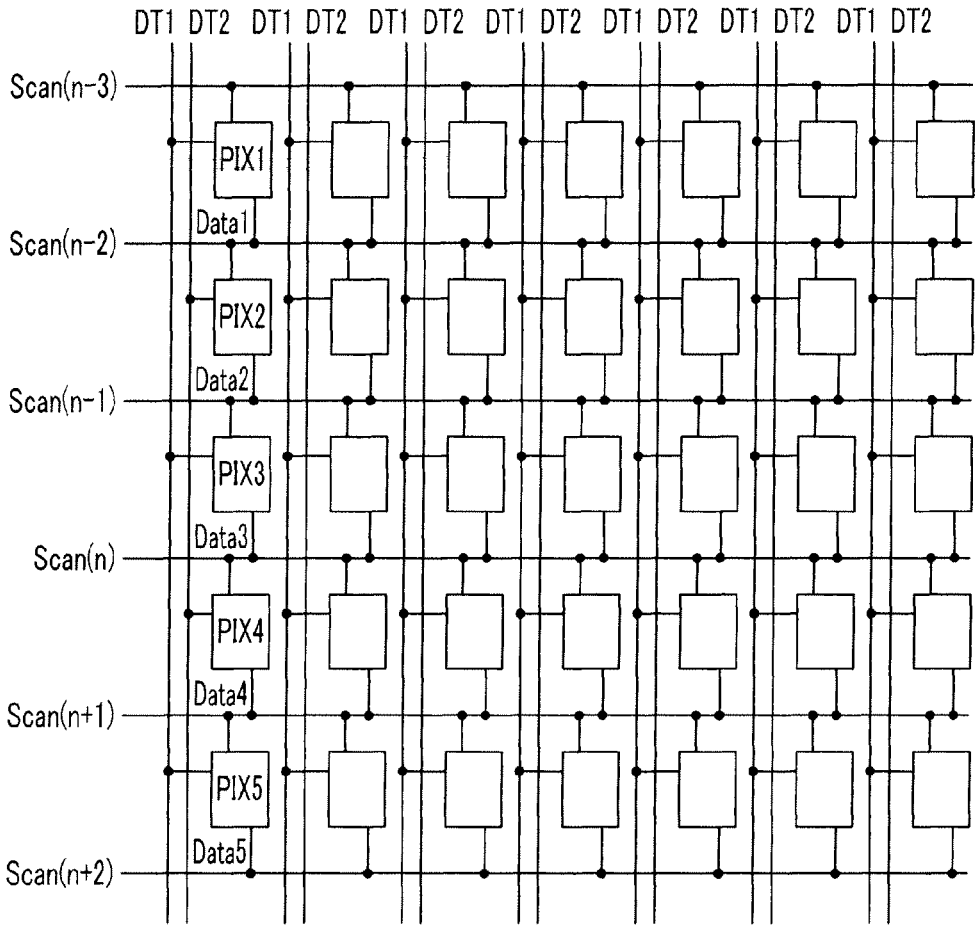
FIG. 8 is an explanatory view for describing an example of the configuration of a display device according to the second exemplary embodiment of the present invention.

FIG. 8 is an explanatory view for describing an example of the configuration of a display device according to the second exemplary embodiment of the present invention.

FIG. 8 depicts an example of the configuration of a display panel included in the display device (hereinafter, also referred to as the display device 200) according to the second exemplary embodiment.

The components other than the display panel of the display device 200 of FIG. 8 may be basically configured in the same manner as those of the display device 100 of FIG. 6 according to the first exemplary embodiment, so a description thereof will be omitted.

In FIG. 8, the power supply line shown in FIG. 6 is omitted.

As shown in FIG. 8, the display panel according to the second exemplary embodiment has data lines which correspond to columns of pixel circuits arranged in a matrix and include a first data line DT1 and a second data line DT2.

Moreover, FIG. 8 depicts an example in which pixel circuits of odd-numbered rows of the display panel according to the second exemplary embodiment are connected to the first data line DT1 and pixel circuits of even-numbered rows of the display panel according to the second exemplary embodiment are connected to the second data line DT2.

The configuration of the display panel according to the second exemplary embodiment is not limited to the configuration of FIG. 8.

For example, the pixel circuits of the odd-numbered rows of the display panel according to the second exemplary embodiment may be connected to the second data line DT2, and the pixel circuits of the even-numbered rows of the display panel according to the second exemplary embodiment may be connected to the first data line DT1.

Also, in the display panel according to the second exemplary embodiment, a pixel circuit at a certain position may be connected to either the first data line DT1 or the second data line DT2.

Figure 9:
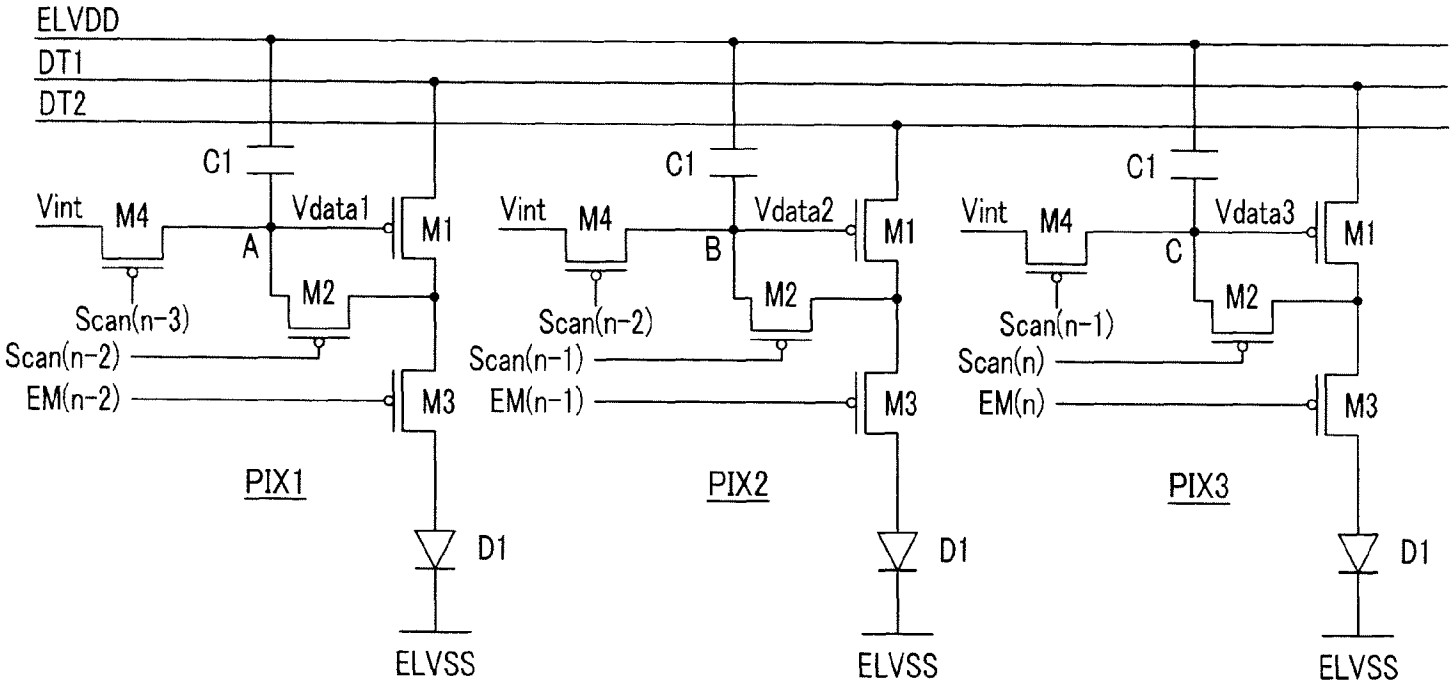
FIG. 9 is an explanatory view for describing an example of pixel circuits of the display panel of FIG. 8 according to the second exemplary embodiment.

FIG. 9 is an explanatory view for describing an example of pixel circuits of the display panel of FIG. 8 according to the second exemplary embodiment. FIG. 9 depicts an example of the configuration of some pixels PIX1, PIX2, and PIX3 of the display panel of FIG. 8 according to the second exemplary embodiment.

As shown in FIG. 9, the pixels PIX1, PIX2, and PIX3 each have the same configuration as the pixel circuit of FIG. 1 according to the first exemplary embodiment.

First terminals of transistors M1 (driving transistors) of the pixels PIX1 and PIX3 are connected to the first data line DT1, and a first terminal of a transistor M1 (driving transistor) of the pixel PIX2 is connected to the second data line DT2.

The configuration of the pixel circuits of the display panel according to the second exemplary embodiment is not limited to the configuration of FIG. 9.

For example, the display panel according to the second exemplary embodiment of the present invention may have pixels configured according to the pixel circuit of FIG. 3 of the modification of the first exemplary embodiment, the pixel circuit of FIG. 4 of the second exemplary embodiment, or a pixel circuit of a modification of the second exemplary embodiment.

Next, an operation of the pixel circuits of FIG. 9 of the display panel of the display device 200 according to the second exemplary embodiment will be described.

Figure 10:
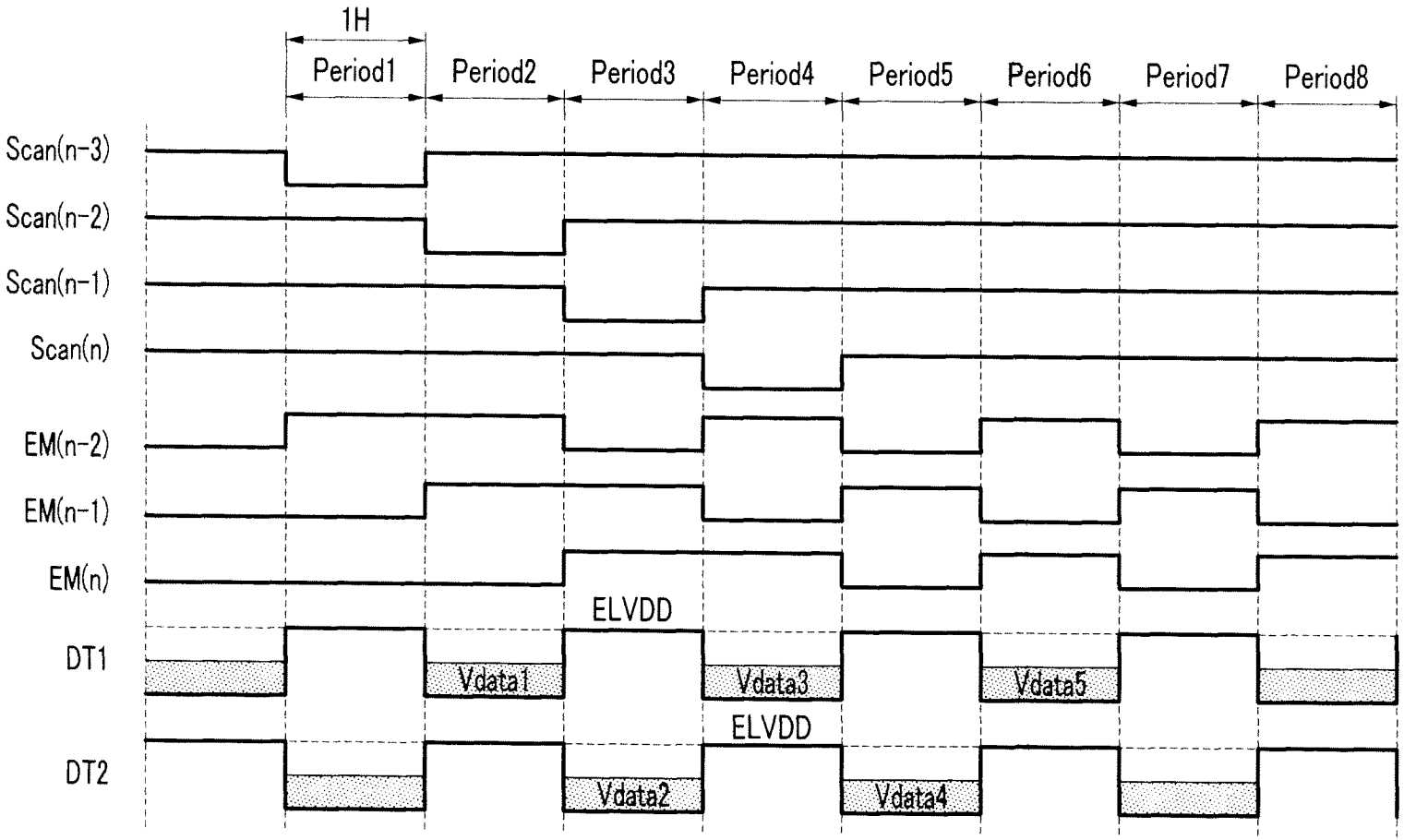
FIG. 10 is an explanatory view for describing an example of an operation of the pixel circuits of the display device according to the second exemplary embodiment of the present invention.

FIG. 10 is an explanatory view for describing an example of an operation of the pixel circuits of the display device 200 according to the second exemplary embodiment of the present invention.

During a first period, a scan signal Scan(n−3) becomes low level to cause the transistor M4 of the pixel PIX1 to turn on, whereby the potential of the gate terminal of the transistor M1 of the pixel PIX1 is initialized to a potential having the voltage Vint.

Next, during a second period, a scan signal Scan(n−2) becomes low level to cause the transistor M2 of the pixel PIX1 to turn on, whereby a data signal VData1 applied to the data line DT1 is applied to a gate terminal (point A of FIG. 10) of the transistor M1 of the pixel PIX1 via the transistor M1 of the pixel PIX1 and the transistor M2 of the pixel PIX1.

Regarding the connection relationship between the transistor M1 of the pixel PIX1 and the transistor M2 of the pixel PIX1, the gate terminal and second terminal of the transistor M1 are diode-connected.

Accordingly, the voltage Vgate(point A) shown in the following Equation 13 is written to the gate terminal of the transistor M1 of the pixel PIX1, and charge corresponding to the voltage is stored in the capacitor element C1 of the pixel PIX1.

Vgate(point A) of Equation 13 denotes the voltage to be written to the gate terminal of the transistor M1 of the pixel PIX1. Thus, Vdata1 of Equation 13 denotes a voltage represented by the data signal Vdata1.

Vth(PIX) of Equation 13 denotes a threshold voltage representing the threshold value of a voltage at which the transistor M1 of the pixel PIX1 becomes conductive.

$$V\text{gate}(\text{point } A)=V\text{data1}-Vth\ PIX1 \quad \text{Equation 13}$$

Here, the transistor M1 (driving transistor) of the pixel circuit of the pixel PIX1 of FIG. 9 is directly connected to the data line DT1.

However, the transistor M3 is OFF during the non-light emission period, so that the current corresponding to the data signal Vdata does not flow through the light emitting element D1, and the potential of the gate terminal of the transistor M1 is not updated unless the transistor M2 is turned on.

That is, as the transistor M2 of the pixel PIX1 turns on during the second period of the non-light emission period for each frame, an image displayed in response to the data signal is updated.

During the second period, the scan signal Scan(n−2) becomes low level to cause the transistor M4 of the pixel PIX2 to turn on, whereby the potential of the gate terminal of the transistor M1 of the pixel PIX2 is initialized to a potential having the voltage Vint.

Next, during a third period, a scan signal Scan(n−1) becomes low level to cause the transistor M2 of the pixel PIX2 to turn on, whereby a data signal VData2 applied to the data line DT2 is applied to a gate terminal (point B of FIG. 10) of the transistor M1 of the pixel PIX2 via the transistor M1 of the pixel PIX2 and the transistor M2 of the pixel PIX2.

Accordingly, the voltage Vgate (point B) derived by the calculation of FIG. 13 is written to the gate terminal of the transistor M1 of the pixel PIX2, and charge corresponding to the voltage is stored in the capacitor element C1 of the pixel PIX2.

During the third period, the scan signal Scan(n−1) becomes low level to cause the transistor M4 of the pixel PIX3 to turn on, whereby the potential of the gate terminal of the transistor M1 of the pixel PIX3 is initialized to a potential having the voltage Vint.

Next, during a fourth period, a scan signal Scan(n) becomes low level to cause the transistor M2 of the pixel PIX3 to turn on, whereby a data signal VData3 applied to the data line DT1 is applied to a gate terminal (point C of FIG. 10) of the transistor M1 of the pixel PIX3 via the transistor M1 of the pixel PIX3 and the transistor M2 of the pixel PIX3.

Accordingly, the voltage Vgate (point C) derived by the calculation of FIG. 13 is written to the gate terminal of the transistor M1 of the pixel PIX3, and charge corresponding to the voltage is stored in the capacitor element C1 of the pixel PIX3.

Likewise, initialization and data writing are sequentially performed on the pixel circuits corresponding to the pixels PIX4 and PIX5 of FIG. 8 in response to a variety of signals shown in FIG. 9.

Referring again to the third period, during the third period, a light emission signal EM(n−2) becomes low level, and the transistor M3 of the pixel PIX is turned on.

During the third period, the second power supply voltage ELVDD is applied to the data line DT1, and the potential of the data line DT1 is maintained as the potential of the second power supply voltage ELVDD.

At this point, the voltage of both ends of the capacitor element C1 of the pixel PIX1 is equal to a voltage Vgs between the gate terminal and first terminal (source terminal) of the transistor M1 of the pixel PIX1.

The voltage stored in the capacitor element C1 of the pixel PIX1 causes a bias current to be supplied from the data line DT1 to the light emitting element D1 of the pixel PIX1 through the transistor M1 of the pixel PIX1 and the transistor M3 of the pixel PIX1.

Like the current flowing through the transistor M11 of the conventional pixel circuit shown in FIG. 11, the current flowing through the transistor M1 of the pixel PIX1 can be represented by the following Equation 14 when it is in a saturated state.

"β" of Equation 14 denotes a coefficient determined by the size, etc of the transistor M1 of the pixel PIX1, and "Vgs" of Equation 14 denotes a voltage between the gate terminal and first terminal (source terminal) of the transistor M1 of the pixel PIX1.

"Vth" of Equation 14 is a threshold voltage of the transistor M1 of the pixel PIX1.

$$I=\beta(Vgs-Vth)2 \quad \text{Equation 14}$$

The voltage Vgs of Equation 14 is represented by the following Equation 15.

$$Vgs=ELVDD-(V\text{data1}-Vth) \quad \text{Equation 15}$$

Based on Equations 14 and 15, the current flowing through the light emitting element D1 of the pixel PIX1 is represented by the following Equation 16.

$$\begin{aligned} I &= \beta(ELVDD - Vdata1 + Vth - Vth)2 \\ &= \beta(ELVDD - Vdata1)2 \end{aligned} \quad \text{Equation 16}$$

As shown in Equation 16, the threshold voltage Vth of the transistor M1 of the pixel PIX1 is offset.

That is, the current flowing through the light emitting element D1 is not dependent upon the threshold voltage Vth of the transistor M1 of the pixel PIX1.

As such, the display 200 according to the second exemplary embodiment is able to control the amount of current flowing through the light emitting element D1 of the pixel PIX1 by the data signal Vdata1 because variations in the threshold voltage Vth of the transistor M1 of the pixel PIX1 are compensated for in accordance with operations of the variety of signals shown in FIG. 10.

Like the pixel PIX1, the amount of current flowing through the light emitting elements D1 of the pixels PIX2 and PIX3 is controlled by the data signals Vdata2 and Vdata3 because variations in the threshold voltages Vth of the transistors M1 of the pixels PIX2 and PIX3 are compensated for.

Referring again to the pixel PIX1, during a fourth period, the light emission signal EM(n−2) becomes high level to cause the transistor M3 of the pixel PIX to turn off, whereby the current flowing through the light emitting diode D1 of the pixel PIX1 is intercepted to thereby stop light emission of the pixel PIX1.

As described above, during the fourth period in which light emission of the pixel PIX1 is stopped, data writing is performed on the pixel PIX3.

Next, during a fifth period, the light emission signal EM(n−2) becomes low level to cause the transistor M3 of the pixel PIX1 to turn on, whereby light emission of the pixel PIX1 is started again.

As shown in the waveforms of the first and second data lines DT1 and DT2 of FIG. 10, a data driver of the display device according to the second exemplary embodiment of the present invention applies a data signal or a power supply voltage ELVDD (power supply voltage having a potential of a first level) to the first data line DT1 and the second data line DT2 every horizontal scan period (1H period).

The data driver of the display device according to the second exemplary embodiment of the present invention applies the power supply voltage ELVDD (power supply voltage having the potential of the first level) to the second data line, in synchronization with the application of a data signal to the first data line DT1, and applies a data signal to the second data line DT2, in synchronization with the application of the power supply voltage ELVDD to the first data line DT1.

That is, if the display device 200 according to the second exemplary embodiment is driven by the driving method of FIG. 10, a data signal application period (i.e., non-light emission period) and a power supply voltage ELVDD application period (i.e., light emission period) are alternately repeated in the first and second data lines DT1 and DT2.

Also, if the display device 200 according to the second exemplary embodiment is driven by the driving method of FIG. 10, light emission and non-light emission of each pixel are repeated every horizontal scan period after initialization, threshold compensation, and data writing of each pixel are completed.

Hereinafter, as shown in FIG. 10, a driving mode using the driving method for repeating light emission and non-light emission of each pixel every horizontal scan period may be referred to as 'second driving mode'.

Here, the second driving mode according to an exemplary embodiment of the present invention indicates "duty driving.

If the display device 200 is driven in the second driving mode according to the exemplary embodiment of the present invention sequentially perform initialization, threshold compensation, data writing, and light emission (or non-light emission) of a pixel.

Here, the second driving mode according to the exemplary embodiment of the present invention indicates "progressive driving.

If the display device 200 is driven in the second driving mode (so-called simultaneous driving) according to the exemplary embodiment of the present invention, it is not necessary to time-divisionally separate one frame into a non-light emission period (for initialization, threshold compensation, and data writing) and a light emission period, like when the display device 200 is driven in the first driving mode according to the exemplary embodiment of the present invention.

Accordingly, if the display device 200 is driven in the second driving mode, the time required for initialization, threshold compensation, and data writing may be long enough to enable low-frequency driving.

Since the time required for initialization, threshold compensation, and data writing is long enough to enable low-frequency driving, the display device 200 can improve compensation accuracy and data writing time.

As seen from above, the display device 200 according to the second exemplary embodiment of the present invention is configured such that each pixel of the display panel includes a pixel circuit is composed of a pixel circuit according to the above-described exemplary embodiment.

Therefore, the display device 200 according to the second exemplary embodiment can have a reduced number of elements constituting the pixel circuit and achieve high picture quality.

Since the display device 200 has a reduced number of elements constituting the pixel circuit, and is therefore advantageous in realizing a high-precision display panel, compared to the conventional display device using the conventional pixel circuit.

Although the display device 200 according to the second exemplary embodiment is different from the display device 100 according to the first exemplary embodiment in that it has data lines which correspond to columns of pixel circuits arranged in a matrix and include a first data line DT1 and a second data line DT2, both of the display devices 100 and 200 have the same configuration of a pixel circuit of the display panel.

That is, the display device 200 can be driven in the first driving mode (so-called simultaneous driving), like the display device 100 according to the first exemplary embodiment.

Accordingly, the display device 200 may be driven in the second driving mode (so-called progressive driving) or in the first driving mode (so-called simultaneous driving), for example.

If the display device 200 is driven in the first driving mode, the data driver of the display device 200 applies a data signal to the second data line DT2, in synchronization with the application of the data signal to the first data line DT1.

If the display device 200 is driven in the first driving mode, the data driver of the display device applies a power supply voltage ELVDD (power supply voltage having a potential of a first level) to the second data line DT2, in synchronization with the application of the power supply voltage ELVDD to the first data line DT1.

Moreover, the display device 200 may be switched between the first driving mode (so-called simultaneous driving) and the second driving mode (so-called progressive driving).

More specifically, the data driver of the display device 200 may switch between the first driving mode and the second driving mode in response to a transmitted switching signal, for example.

The switching signal according to an exemplary embodiment of the present invention is transmitted from a controller (not shown), for example.

The controller (not shown) generates a switching signal indicative of a driving mode designated by a user operation, and transmits the generated switching signal to the data driver.

Although the switching signal may indicate a driving mode according to high level or low level, the switching signal according to this exemplary embodiment is not limited thereto.

Moreover, the controller (not shown) may generate a switching signal in response to an image signal indicative of an image displayed on the display screen, for example.

As described above, when the display device 200 is driven in the first driving mode according to the exemplary embodiment of the present invention, a stereoscopic image with less crosstalk can be displayed on the display screen.

Also, when displaying a planar image, progressive driving is generally used.

Therefore, if an image signal is for displaying a stereoscopic image, the controller (not shown) generates a switching signal indicative of the first driving mode (so-called simultaneous driving).

Therefore, if an image signal is for displaying a planar image, the controller (not shown) generates a switching signal indicative of the second driving mode (so-called progressive driving).

For example, by driving the display device 200 according to the second exemplary embodiment in the first driving mode (so-called simultaneous driving) when displaying a stereoscopic image on the display screen, and driving it in the second driving mode (so-called progressive driving) when displaying a planar image on the display screen, the display device 200 according to the second exemplary embodiment can display an image on the display screen by using appropriate driving methods for 2D display and 3D display, respectively.

Although the foregoing description has been made on a display device according to an exemplary embodiment of the present invention, the exemplary embodiment of the present invention is not limited thereto.

An exemplary embodiment of the present invention may be applicable to various kinds of devices, including communication devices such as portable phones and smartphones, computers such as personal computers (PCs), image pick devices such as digital cameras (digital steel cameras/digital video cameras), game machines, television sets, and so on, which can use an organic EL display as a display device.

Although exemplary embodiments of the present invention have been described with reference to the accompanying drawings, it is apparent that the present invention is not limited to this example set forth above.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Description of Symbols

100 display device
102 display panel
104 scan driver
106 data driver

What is claimed is:

1. A pixel circuit comprising:

a light emitting element whose cathode is connected to a first power source for supplying a first power supply voltage;

a first transistor that has a first terminal connected to a data line and is selectively conducted with a voltage applied to a gate terminal;

a second transistor that is connected between the gate terminal of the first transistor and a second terminal of the first transistor and is selectively conducted in response to a first scan signal applied to a gate terminal;

a third transistor that is connected between the second terminal of the first transistor and an anode of the light emitting element and is selectively conducted in response to a light emission control signal applied to a gate terminal;

a fourth transistor that is connected between the gate terminal of the first transistor and an initialization power source and is selectively conducted in response to a second scan signal applied to a gate terminal; and a capacitor element, one end of which is connected to a power source for supplying a voltage having a fixed potential and the other end of which is connected to the gate terminal of the first transistor, wherein, during a non-light emission period of one frame in which the light emitting element emits no light, a data signal is applied to the data line, and during a light emission period of one frame in which the light emitting element emits light in response to the data signal, a second power supply voltage having a higher potential than the first power supply voltage is applied to the data line.

2. The pixel circuit of claim 1, wherein the third transistor is conducted not during the non-light emission period but during the light emission period.

3. The pixel circuit of claim 1, wherein the power source to which one end of the capacitor element is connected is a second power source for supplying the second power supply voltage.

4. The pixel circuit of claim 1, wherein the power source to which one end of the capacitor element is connected is the initialization power source.

5. The pixel circuit of claim 1, wherein during a first period of the non-light emission period, the fourth transistor is conducted to thus initialize the potential of the gate terminal of the first transistor to the potential of a voltage supplied from the initialization power source, and during a second period subsequent to the first period of the non-light emission period, the second transistor is conducted to thus perform a threshold compensation operation for compensating for a threshold voltage conducted by the first transistor and a data writing operation for storing charge corresponding to the data signal in the capacitor element.

6. The pixel circuit of claim 5, wherein the third transistor is conducted not during the non-light emission period but during the light emission period.

7. The pixel circuit of claim 5, wherein the power source to which one end of the capacitor element is connected is a second power source for supplying the second power supply voltage.

8. The pixel circuit of claim 5, wherein the power source to which one end of the capacitor element is connected is the initialization power source.

9. A pixel circuit comprising:

a first transistor that has a first terminal connected to a data line and is selectively conducted with a voltage applied to a gate terminal;

a second transistor that is connected between the gate terminal of the first transistor and a second terminal of the first transistor and is selectively conducted in response to a first scan signal applied to a gate terminal;

a fourth transistor that is connected between the gate terminal of the first transistor and an initialization power source and is selectively conducted in response to a second scan signal applied to a gate terminal;

a capacitor element, one end of which is connected to a power source for supplying a voltage having a fixed potential and the other end of which is connected to the gate terminal of the first transistor; and a light emitting element whose cathode is connected to a first power source for supplying a power supply voltage having a potential of a first level or a potential of a second level which is lower than the first level and whose anode is connected to the second terminal of the first transistor, wherein, during a non-light emission period of one frame in which the light emitting element emits no light, a data signal is applied to the data line, and the potential of the power supply voltage supplied from the first power source is fixed to the potential of the first level, and during a light emission period of one frame in which the light emitting element emits light in response to the data signal, the power supply voltage having the potential of the first level is applied to the data line, and the potential of the power supply voltage supplied from the first power source is changed from the potential of the first level to the potential of the second level.

10. A display device comprising:

a display unit that has data lines and scan lines arranged in a matrix and pixel circuits arranged in a matrix so as to correspond to crossing points of the data lines and the scan lines;

a scan driver that applies a scan signal to the scan lines; and a data driver that applies a data signal to the data lines, each of the pixel circuits comprising:

a light emitting element whose cathode is connected to a first power source for supplying a first power supply voltage;

a first transistor that has a first terminal connected to a data line and is selectively conducted with a voltage applied to a gate terminal;

a second transistor that is connected between the gate terminal of the first transistor and a second terminal of the first transistor and is selectively conducted in response to a first scan signal applied to a gate terminal;

a third transistor that is connected between the second terminal of the first transistor and an anode of the light emitting element and is selectively conducted in response to a light emission control signal applied to a gate terminal;

a fourth transistor that is connected between the gate terminal of the first transistor and an initialization power source and is selectively conducted in response to a second scan signal applied to a gate terminal; and a capacitor element, one end of which is connected to a power source for supplying a voltage having a fixed potential and the other end of which is connected to the gate terminal of the first transistor, during a non-light emission period of one frame in which the light emitting element emits no light, the data driver applies a data signal to the data line, and during a light emission period of one frame in which the light emitting element emits light in response to the data signal, the data driver applies a second power supply voltage having a higher potential than the first power supply voltage to the data line.

11. The display device of claim 10, wherein the non-light emission period for each of the pixel circuits constituting the display unit is synchronized with the light emission period for each of the pixel circuits constituting the display unit.

12. The display device of claim 10, wherein the data driver alternately applies a data signal for a right-eye image of a stereoscopic image and a data signal for a left-eye image of the stereoscopic image during one frame period.

13. The display device of claim 10, wherein the display unit has data lines which correspond to columns of pixel circuits arranged in the matrix and includes a first data line to which a first data signal is applied and a second data line to which a second data signal is applied, and the first terminal of the first transistor of the pixel circuit is connected to either the first data line or the second data line.

14. The display device of claim 13, wherein the pixel circuits of odd-numbered rows of the display unit are connected to either the first data line or the second data line, and the pixel circuits of even-numbered rows of the display unit are connected to either the first data line or the second data line.

15. The display device of claim 13, wherein the data driver applies a data signal or the power supply voltage having the potential of a first level to the first data line every horizontal scan period, applies the power supply voltage having the potential of the first level to the second data line, in synchronization with the application of the data signal to the first data line, and applies the data signal to the second data line, in synchronization with the application of the power supply voltage having the potential of the first level to the first data line.

16. The display device of claim 13, wherein the data driver applies a data signal to the second data line, in synchronization with the application of the data signal to the first data line, and applies the power supply voltage having the potential of a first level to the second data line, in synchronization with the application of the power supply voltage having the potential of the first level to the first data line.

17. The display device of claim 13, wherein the data driver switches between a first driving mode and a second driving mode in response to a switching signal, and in the first driving mode, the data driver applies a data signal to the second data line, in synchronization with the application of the data signal to the first data line and applies the power supply voltage having the potential of a first level to the second data line, in synchronization with the application of the power supply voltage having the potential of the first level to the first data line, and in the second driving mode, the data driver applies a data signal or the power supply voltage having the potential of the first level to the first data line every horizontal scan period, in synchronization with the application of the power supply voltage having the potential of the first level to the first data line and applies a data signal to the second data line, in synchronization with the application of the power supply voltage having the potential of the first level to the first data line.

18. The display device of claim 14, wherein the data driver applies a data signal or the power supply voltage having the potential of a first level to the first data line every horizontal scan period, applies the power supply voltage having the potential of the first level to the second data line, in synchronization with the application of the data signal to the first data line, and applies the data signal to the second data line, in synchronization with the application of the power supply voltage having the potential of the first level to the first data line.

19. The display device of claim 14, wherein the data driver applies a data signal to the second data line, in synchronization with the application of the data signal to the first data line, and applies the power supply voltage having the potential of a first level to the second data line, in synchronization with the application of the power supply voltage having the potential of the first level to the first data line.

20. The display device of claim 14, wherein the data driver switches between a first driving mode and a second driving mode in response to a switching signal, and in the first driving mode, the data driver applies a data signal to the second data line, in synchronization with the application of the data signal to the first data line and applies the power supply voltage having the potential of a first level to the second data line, in synchronization with the application of the power supply voltage having the potential of the first level to the first data line, and in the second driving mode, the data driver applies a data signal or the power supply voltage having the potential of the first level to the first data line every horizontal scan period, in synchronization with the application of the power supply voltage having the potential of the first level to the first data line and applies a data signal to the second data line, in synchronization with the application of the power supply voltage having the potential of the first level to the first data line.

21. A display device comprising:

a display unit that has data lines and scan lines arranged in a matrix and pixel circuits arranged in a matrix so as to correspond to crossing points of the data lines and the scan lines;

a scan driver that applies a scan signal to the scan lines; and a data driver that applies a data signal to the data lines, each of the pixel circuits comprising:

a first transistor that has a first terminal connected to a data line and is selectively conducted with a voltage applied to a gate terminal;

a second transistor that is connected between the gate terminal of the first transistor and a second terminal of the first transistor and is selectively conducted in response to a first scan signal applied to a gate terminal;

a fourth transistor that is connected between the gate terminal of the first transistor and an initialization power source and is selectively conducted in response to a second scan signal applied to a gate terminal;

a capacitor element, one end of which is connected to a power source for supplying a voltage having a fixed potential and the other end of which is connected to the gate terminal of the first transistor; and a light emitting element whose cathode is connected to a first power source for supplying a power supply voltage having a potential of a first level or a potential of a second level which is lower than the first level and whose anode is connected to the second terminal of the first transistor, wherein the data driver applies a data signal to the data line during a non-light emission period of one frame in which the light emitting element emits no light, and applies the power supply voltage having the potential of the first level to the data line during a light emission period of one frame in which the light emitting element emits light in response to the data signal, and the potential of the power supply voltage supplied from the first power source is fixed during the non-light emission period, and is changed from the potential of the first level to the potential of the second level during the light emission period.

22. The display device of claim 21, wherein the non-light emission period for each of the pixel circuits constituting the display unit is synchronized with the light emission period for each of the pixel circuits constituting the display unit.

23. The display device of claim 21, wherein the data driver alternately applies a data signal for a right-eye image of a stereoscopic image and a data signal for a left-eye image of the stereoscopic image during one frame period.

24. The display device of claim 21, wherein the display unit has data lines which correspond to columns of pixel circuits arranged in the matrix and includes a first data line to which a first data signal is applied and a second data line to which a second data signal is applied, and the first terminal of the first transistor of the pixel circuit is connected to either the first data line or the second data line.

25. The display device of claim 24, wherein the pixel circuits of the odd-numbered rows of the display unit are connected to either the first data line or the second data line, and the pixel circuits of the even-numbered rows of the display unit are connected to either the first data line or the second data line.

26. The display device of claim 25, wherein the data driver applies a data signal or the power supply voltage having the potential of the first level to the first data line every horizontal scan period, applies the power supply voltage having the potential of the first level to the second data line, in synchronization with the application of the data signal to the first data line, and applies the data signal to the second data line, in synchronization with the application of the power supply voltage having the potential of the first level to the first data line.

27. The display device of claim 25, wherein the data driver applies a data signal to the second data line, in synchronization with the application of the data signal to the first data line, and applies the power supply voltage having the potential of the first level to the second data line, in synchronization with the application of the power supply voltage having the potential of the first level to the first data line.

28. The display device of claim 25, wherein the data driver switches between a first driving mode and a second driving mode in response to a switching signal, and in the first driving mode, the data driver applies a data signal to the second data line, in synchronization with the application of the data signal to the first data line and applies the power supply voltage having the potential of the first level to the second data line, in synchronization with the application of the power supply voltage having the potential of the first level to the first data line, and in the second driving mode, the data driver applies a data signal or the power supply voltage having the potential of the first level to the first data line every horizontal scan period, in synchronization with the application of the power supply voltage having the potential of the first level to the first data line and applies a data signal to the second data line, in synchronization with the application of the power supply voltage having the potential of the first level to the first data line.

29. The display device of claim 24, wherein the data driver applies a data signal or the power supply voltage having the potential of the first level to the first data line every horizontal scan period, applies the power supply voltage having the potential of the first level to the second data line, in synchronization with the application of the data signal to the first data line, and applies the data signal to the second data line, in synchronization with the application of the power supply voltage having the potential of the first level to the first data line.

30. The display device of claim 24, wherein the data driver applies a data signal to the second data line, in synchronization with the application of the data signal to the first data line, and applies the power supply voltage having the potential of the first level to the second data line, in synchronization with the application of the power supply voltage having the potential of the first level to the first data line.

31. The display device of claim 24, wherein the data driver switches between a first driving mode and a second driving mode in response to a switching signal, and in the first driving mode, the data driver applies a data signal to the second data line, in synchronization with the application of the data signal to the first data line and applies the power supply voltage having the potential of the first level to the second data line, in synchronization with the application of the power supply voltage having the potential of the first level to the first data line, and in the second driving mode, the data driver applies a data signal or the power supply voltage having the potential of the first level to the first data line every horizontal scan period, in synchronization with the application of the power supply voltage having the potential of the first level to the first data line and applies a data signal to the second data line, in synchronization with the application of the power supply voltage having the potential of the first level to the first data line.

* * * * *